US005660975A

United States Patent [19]

Ito et al.

[11] Patent Number: 5,660,975

[45] Date of Patent: Aug. 26, 1997

[54] SILVER HALIDE COLOR PHOTOGRAPHIC MATERIAL

[75] Inventors: Takayuki Ito; Naoto Matsuda, both of Kanagawa, Japan

[73] Assignee: Fuji Photo Film Co., Ltd., Kanagawa, Japan

[21] Appl. No.: 710,122

[22] Filed: Sep. 12, 1996

[30] Foreign Application Priority Data

Sep. 12, 1995 [JP] Japan ..... 7-258335

[51] Int. Cl.[6] ..... G03C 7/305; G03C 7/38

[52] U.S. Cl. ..... 430/544; 430/558; 430/955; 430/957

[58] Field of Search ..... 430/957, 558, 430/544, 955

[56] References Cited

U.S. PATENT DOCUMENTS

| | | | |
|---|---|---|---|
| 4,818,668 | 4/1989 | Ichijima et al. | 430/505 |
| 5,128,237 | 7/1992 | Kimura et al. | 430/505 |
| 5,256,526 | 10/1993 | Suzuki et al. | 430/384 |
| 5,270,153 | 12/1993 | Suzuki et al. | 430/558 |
| 5,384,236 | 1/1995 | Metsuoka et al. | 430/558 |

FOREIGN PATENT DOCUMENTS

| | | |
|---|---|---|
| 63-10813 | 3/1988 | Japan . |
| 7-48376 | 2/1995 | Japan . |

*Primary Examiner*—Lee C. Wright

*Attorney, Agent, or Firm*—Birch, Stewart, Kolasch & Birch, LLP

[57] ABSTRACT

A silver halide color photographic material comprising at least one layer provided on a support, said layer containing a coupler represented by the following formula (1):

(1)

wherein $Z_a$ represents —C($R_3$)= or —N=; $Z_b$ represents —C($R_3$)= when $Z_a$ is —N= or $Z_b$ represents —N= when $Z_a$ is —C($R_3$)=; $R_1$ and $R_2$ each represents an electron attractive group having a Hammett substituent constant $\sigma_p$ of 0.2 to 1.0; $R_3$ represents a substituent; T represents a linking group which can be released from the coupler by coupling thereof with an oxidized color developing agent and can subsequently release an ED moiety; n represents 0 or 1; the ED moiety represents a group which can be released from the coupler or T to undergo a redox reaction with the oxidized color developing agent; and G represents a hydrogen atom or a blocking group which can be eliminated from the coupler on photographic processing, whereby good hues and high image quality can be attained without any sensitivity decrease.

14 Claims, No Drawings

SILVER HALIDE COLOR PHOTOGRAPHIC MATERIAL

FIELD OF THE INVENTION

The present invention relates to a silver halide color photographic material, and more specifically to a silver halide color photographic material containing cyan couplers which can attain good hues and high image quality.

BACKGROUND OF THE INVENTION

In silver halide color photographic materials, it is well known that aromatic primary amine type color developing agents oxidized by exposed silver halide which acts as a oxidizing agent react with couplers to form indophenol, indoaniline, indamine, azomethine, phenoxazine, phenazine, and their related dyes, thus forming color images. The subtractive process is used for such a photographic system, and color images are formed by yellow, magenta, and cyan dyes. Among these color images, to form cyan color images, phenol or naphthol type couplers have been hitherto employed in general. However, these couplers have the serious disadvantage of markedly lowering color reproduction, because of unfavorable absorption thereof in the green region.

Couplers for solving the problem, pyrrolotriazoles, have been proposed in EP-A-491197, EP-A-488248 and EP-A-545300. In addition to excellent hues of dyes formed by coupling with oxidized color developing agents, the couplers feature high coupling activity and high molar absorption coefficients of the dyes formed (about 2 to 3 times that of the dyes formed from the phenol or naphthol type couplers). However, the use of the pyrrolotriazoles described in these specifications results in a deterioration in graininess and sharpness. Particularly, the pyrrolotriazoles have the disadvantage of lowering sensitivity in the processing of color reversal in which color development is carried out after black-and-white development. These problems have been expected to be solved.

SUMMARY OF THE INVENTION

An object of the present invention is to provide a silver halide color photographic material containing a cyan coupler which can offer good hues and high image quality.

The object of the present invention has been attained by a silver halide color photographic material comprising at least one layer provided on a support, said layer containing a coupler represented by the following formula (1):

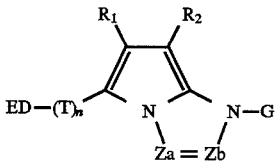

(1)

wherein $Z_a$ represents —C($R_3$)= or —N=; $Z_b$ represents —C($R_3$)= when $Z_a$ is —N= or $Z_b$ represents —N= when $Z_a$ is —C($R_3$)=; $R_1$ and $R_2$ each represents an electron attractive group having a Hammett substituent constant $\sigma_p$ of 0.2 to 1.0; $R_3$ represents a substituent; T represents a linking group which can be released from the coupler by coupling thereof with an oxidized color developing agent and can subsequently release an ED moiety; n represents 0 or 1; the ED moiety represents a group which can be released from the coupler or T to undergo a redox reaction with an oxidized color developing agent; and G represents a hydrogen atom or a blocking group which can be eliminated from the coupler on photographic processing.

DETAILED DESCRIPTION OF THE INVENTION

The couplers for use in the present invention can be more specifically represented by the following formula (2) or (3):

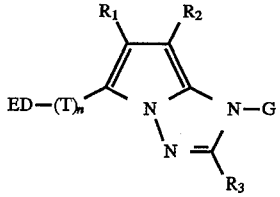

(2)

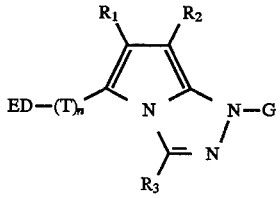

(3)

wherein $R_1$ to $R_3$, T, n, ED and G have the same meanings as those of formula (1), respectively. In the present invention, the couplers represented by formula (2) are preferred to those represented by formula (3).

In the couplers for use in the present invention, $R_1$ and $R_2$ are electron attractive groups having Hammett substituent constants $\sigma_p$ of 0.2 to 1.0, and the sum of the substituent constants of $R_1$ and $R_2$ is preferably 0.65 or more. The couplers for use in the present invention exhibit excellent capability as cyan couplers by introducing such strong electron attractive groups. The sum of $\sigma_p$ values of $R_1$ and $R_2$ is more preferably from about 0.7 to about 1.8.

In the present invention, $R_1$ and $R_2$ are electron attractive groups having Hammett substituent constants $\sigma_p$ (hereinafter merely referred to as $\sigma_p$) of from 0.2 to 1.0, and preferably from 0.3 to 0.80. Hammett's rule is a rule of thumb which is proposed by L. P. Hammett in 1935 to quantitatively discuss the effect of substituents on reactions and equilibrium of benzene derivatives, and today this rule is widely recognized as reasonable. There are two kinds of substituent constants, $\sigma_p$ and $\sigma_m$, which have been determined by the Hammett's rule, and values thereof are described in many specialized books, for example, *Lange's Handbook of Chemistry*, edited by J. A. Dean, 12th edition, McGraw-Hill (1979); *Kagaku no Ryoiki; Zokan (Region of Chemistry*; Extra Edition, Vol. 122, pp. 96 to 103, Nankodo (1979); and Chemical Reviews, Vol. 91, pp. 165 to 195 (1991). Although substituents represented by $R_1$ and $R_2$ are specified by $\sigma_p$ values in the present invention, they are not limited to substituents whose $\sigma_p$ values available in the literature are within the above-mentioned range. It should be taken as a matter of course that substituents usable as $R_1$ and $R_2$ include substituents whose $\sigma_p$ values are unknown in the literature but will be within the range if their $\sigma_p$ values are measured according to the Hammett's rule.

Examples of the substituents represented by $R_1$ and $R_2$ which are electron attractive groups having $\sigma_p$ values of 0.2 to 1.0 include acyl groups, acyloxy groups, carbamoyl groups, aliphatic oxycarbonyl groups, aryl oxycarbonyl groups, a cyano group, a nitro group, dialkylphosphono groups, diarylphosphono groups, diarylphosphinyl groups, alkyl-phosphinyl groups, arylsulfinyl groups, alkylsulfonyl groups, arylsulfonyl groups, sulfonyloxy groups, acylthio groups, sulfamoyl groups, a thiocyanate group, a thiocarbonyl group, alkyl groups substituted by at least 2 or more halogen atoms, alkoxy groups substituted by at least 2 or more halogen atoms, aryloxy groups substituted by at least 2 or more halogen atoms, alkylamino groups substituted by at least 2 or more halogen atoms, alkylthio groups substituted by at least 2 or more halogen atoms, aryl groups substituted by additional electron attractive groups having $\sigma_p$ values of 0.20 or more, heterocyclic groups, a chlorine atom, a bromine atom, an azo group, and a selenocyanate group. Among these groups, groups which can further contain substituents may further contain substituents as enumerated later as $R_3$.

The aliphatic moieties of the above-mentioned aliphatic oxycarbonyl groups may have a straight-chain structure, a branched-chain structure, or a cyclic structure, and may be saturated or may contain unsaturated bonds. The aliphatic oxycarbonyl groups include alkoxycarbonyl groups, cycloalkoxycarbonyl groups, alkenyloxycarbonyl groups, alkynyloxycarbonyl groups, and cycloalkenyloxycarbonyl groups. The term "aliphatic" hereinafter have the same meanings as above.

Examples of typical electron attractive groups having $\sigma_p$ values of 0.2 to 1.00 are as follows ($\sigma_p$ values are given in parentheses): a bromine atom (0.23), a chlorine atom (0.23), a cyano group (0.66), a nitro group (0.78), a trifluoromethyl group (0.54), a tribromomethyl group (0.29), a trichloromethyl group (0.33), a carboxyl group (0.45), an acetyl group (0.50), a benzoyl group (0.43), an acetyloxy group (0.31), a trifluoromethanesulfonyl group (0.92), methanesulfonyl group (0.72), a benzenesulfonyl group (0.70), a methanesulfinyl group (0.49), a carbamoyl group (0.36), a methoxycarbonyl group (0.45), an ethoxycarbonyl group (0.45), a phenoxycarbonyl group (0.44), a pyrazolyl group (0.37), a methanesulfonyloxyl (0.36), a dimethoxyphosphoryl group (0.60), and a sulfamoyl group (0.57).

Examples of preferred substituents used as $R_1$ include a cyano group, aliphatic oxycarbonyl groups having 36 or less carbon atoms (for example, methoxycarbonyl, ethoxycarbonyl, dodecyloxycarbonyl, octadecyloxycarbonyl, 2-ethylhexyloxycarbonyl, sec-butyloxycarbonyl, oleyloxycarbonyl, benzyloxycarbonyl, propargyloxycarbonyl, cyclopentyloxycarbonyl, cyclohexyloxycarbonyl, and 2,6-di-t-butyl-4-methylcyclohexyloxycarbonyl), dialkylphosphono groups having 36 or less carbon atoms (for example, dimethylphosphono and diethylphosphono), alkylsulfonyl or arylsulfonyl groups having 36 or less carbon atoms (for example, methanesulfonyl, butanesulfonyl, benzenesulfonyl, and p-toluenesulfonyl), and fluorinated alkyl groups having 36 or less carbon atoms (for example, trifluoromethyl). More preferred substituents used as $R_1$ are the cyano group, the aliphatic oxycarbonyl groups, and the fluorinated alkyl groups, and a most preferred substituent is the cyano group.

Examples of preferred substituents used as $R_2$ include aliphatic oxycarbonyl groups as enumerated as $R_1$, carbamoyl groups having 36 or less carbon atoms (for example, diethylcarbamoyl and dioctylcarbamoyl), sulfamoyl groups having 36 or less carbon atoms (for example, dimethylsulfamoyl and dibutylsulfamoyl), dialkylphosphono groups as enumerated as $R_1$, and diarylphosphono groups having 48 or less carbon atoms (for example, diphenylphosphono and di(p-toluylphosphono)). More preferred substituents used as $R_2$ are aliphatic oxycarbonyl groups represented by the following formula (4):

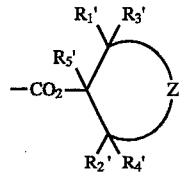

(4)

In formula (4), $R_1'$ and $R_2'$ each represents an aliphatic group having 36 or less carbon atoms (for example, methyl, ethyl, propyl, isopropyl, t-butyl, t-amyl, t-octyl, tridecyl, cyclopentyl, cyclohexyl). $R_3'$, $R_4'$ and $R_5'$ each represents a hydrogen atom or an aliphatic group, examples of which include the groups described above as $R_1'$ and $R_2'$, and $R_3'$, $R_4'$ and $R_5$ each are preferably a hydrogen atom. Z represents a group of nonmetallic atoms required to form a 5- to 8-membered ring, which may be substituted, and may be saturated or may contain a unsaturated bond. The nonmetallic atoms preferably include a nitrogen atom, an oxygen atom, a sulfur atom, or a carbon atom, and more preferably a carbon atom.

Examples of rings containing Z include a cyclopentane ring, a cyclohexane ring, a cycloheptane ring, a cyclooctane ring, a cyclohexene ring, a piperazine ring, an oxane ring, and a thiane ring. These rings may contain substituents represented by $R_3$ described later. A preferred ring containing Z is a cyclohexane ring which may be substituted, and a cyclohexane ring substituted by an alkyl group having 24 or less carbon atoms (which may further contain substituents represented by $R_3$ described layer) at the 4-position is particularly preferred.

$R_3$ represents a substituent. Examples thereof include halogen atoms (for example, a fluorine atom, a chlorine atom, or a bromine atom), aliphatic groups preferably having 36 or less carbon atoms (for example, methyl, ethyl, propyl, isopropyl, t-butyl, t-amyl, t-octyl, tridecyl, cyclopentyl, or a cyclohexyl), aryl groups preferably having 36 or less carbon atoms (for example, phenyl, 1-naphthyl, or 2-naphthyl), heterocyclic groups which preferably have 36 or less carbon atoms and are 5- to 8-membered rings (for example, 2-thienyl, 4-pyridyl, 2-furyl, 2-pyrimidyl, 1-pyridyl, 2-benzothiazolyl, 1-imidazolyl, 1-pyrazolyl, and benzotriazol-2-yl), a cyano group, a hydroxyl group, a nitro group, a carboxyl group, a sulfo group, aliphatic oxy groups preferably having 36 or less carbon atoms (for example, methoxy, ethoxy, 1-butoxy, 2-butoxy, isopropoxy, t-butoxy, cyclopropyloxy, cyclopentyloxy, and cyclohexyloxy), aryloxy groups preferably having 36 or less carbon atoms (for example, phenoxy and 2-naphthoxy), heterocyclic oxy groups preferably having 36 or less carbon atoms (for example, 1-phenyltetrazole-5-oxy, 2-tetrahydropyranyloxy and 2-furyloxy), acylamino groups preferably having 36 or less carbon atoms (for example, acetamido and benzamido), amino groups preferably having 36 or less carbon atoms (for example, amino, N-methylamino, N,N-diethylamino, and N,N-dioctadecylamino), anilino groups preferably having 36 or less carbon atoms (for example, anilino and N-methylanilino), heterocyclic amino groups preferably having 36 or less carbon atoms (for example, 4-pyridylamino), ureido groups preferably having 36. or less carbon atoms (for example, N,N-dimethylureido and N-phenylureido), sulfamoylamino groups preferably having 36 or less carbon atoms (for example, N,N-dipropylsulfamoylamino and N-ethylsulfamoylamino), aliphatic thio groups preferably having 36 or less carbon atoms (for example, methylthio and ethylthio), arylthio groups preferably having 36 or less carbon atoms (for example, phenylthio), heterocyclic thio groups preferably having 36 or less carbon atoms (for example, 2-benzothiazolylthio, 2-pyridylthio and 1-phenyltetrazolylthio), aliphatic oxycarbonylamino groups preferably having 36 or less carbon atoms (for example, methoxycarbonylamino, ethoxycarbonylamino and t-butoxycarbonylamino), aryloxycarbonylamino groups preferably having 36 or less carbon atoms (for example, phenoxycarbonylamino), sulfonamido groups preferably having 36 or less carbon atoms (for example, methanesulfonamido, ethanesulfonamido and benzenesulfonamido), carbamoyl groups having 36 or less carbon atoms (for example, carbamoyl, N,N-dimethylcarbamoyl and N-propylcarbamoyl) sulfamoyl groups preferably having 36 or less carbon atoms (for example, sulfamoyl, N,N-dimethylsulfamoyl, N-ethylsulfamoyl, and N-phenylsulfamoyl), sulfonyl groups such as alkylsulfonyl or arylsulfonyl groups preferably having 36 or less carbon atoms (for example, methanesulfonyl and benzenesulfonyl), aliphatic oxycarbonyl groups preferably having 36 or less carbon atoms (for example, ethoxycarbonyl, t-butoxycarbonyl and cyclohexyloxycarbonyl), aryloxycarbonyl groups preferably having 36 or less carbon atoms (for example, phenoxycarbonyl), azo groups preferably having 36 or less carbon atoms (for example, phenylazo), acyloxy groups preferably having 36 or less carbon atoms (for example, acetoxy, pivaloyloxy and benzolyoxy), carbamoyloxy groups preferably having 36 or less carbon atoms (for example, N,N-dimethylcarbamoyloxy and N-butylcarbamoyloxy), sulfamoyloxy groups preferably having 36 or less carbon atoms (for example, N,N-diethylsulfamoyloxy and N-propylsulfamoyloxy), silyloxy groups preferably having 36 or less carbon atoms (for example, trimethylsilyloxy, t-butyldimethylsilyloxy and triphenylsilyloxy), imido groups preferably having 36 or less carbon atoms (for example, N-succinimido and N-phthalimido), sulfinyl groups such as alkylsulfinyl and arylsulfinyl groups preferably having 36 or less carbon atoms (for example, butanesulfinyl and benzenesulfinyl), phosphonyl groups preferably having 36 or less carbon atoms (for example, phenoxyphosphonyl, octyloxyphosphonyl and phenylphosphonyl), and acyl groups preferably having 36 or less carbon atoms (for example, formyl, acetyl, pivaloyl, and benzoyl). Preferred substituents used as $R_3$ are straight-chain, branched-chain, or cyclic alkyl groups, and aryl groups.

These substituents may contain additional substituents. Examples of preferred additional substituents include halogen atoms, aliphatic groups, aryl groups, heterocyclic groups, a cyano group, a hydroxyl group, a nitro group, a carboxyl group, a sulfo group, aliphatic oxy groups, aryloxy groups, heterocyclic oxy groups, acylamino groups, amino groups, anilino groups, heterocyclic amino groups, ureido groups, sulfamoylamino groups, aliphatic thio groups, arylthio groups, heterocyclic thio groups, aliphatic oxycarbonylamino groups, aryloxycarbonylamino groups, sulfonamido groups, carbamoyl groups, sulfamoyl groups, sulfonyl groups, aliphatic oxycarbonyl groups, aryloxycarbonyl groups, azo groups, acyloxy groups, carbamoyloxy groups, sulfamoyloxy groups, silyloxy groups, imido groups, sulfinyl groups, phosphonyl groups, acyl groups and azolyl groups.

T represents a linking group which can be released from the coupler by coupling thereof with the oxidized color developing agent and can subsequently release the ED moiety. T can be specifically represented by the following formula (5):

$$-(T_1)_{m_1}-(T_2)_{m_2}-(T_3)_{m_3}- \quad (5)$$

wherein $m_1$ to $m_3$ are 0 or 1; and $T_1$ to $T_3$ are linking groups represented by the following formula (5-1), (5-2) or (5-3):

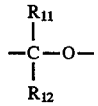
(5-1)

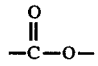
(5-2)

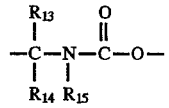
(5-3)

In the formulas, $R_{11}$ and $R_{12}$ each represents a hydrogen atom, an alkyl group having 24 or less carbon atoms (for example, methyl, ethyl, propyl, isopropyl, butyl, t-butyl, t-octyl, and octadecyl), or an aryl group having 24 or less carbon atoms (for example, phenyl, i-naphthyl and 2-naphthyl). The alkyl groups and the aryl groups represented by $R_{11}$ and $R_{12}$ may contain substituents as represented by $R_3$. However, $R_{11}$ and $R_{12}$ are preferably hydrogen atoms. $R_{13}$ and $R_{14}$ have the same meanings as the groups represented by $R_{11}$ and $R_{12}$. Although $R_{15}$ also has the same meanings as the groups represented by $R_{11}$ and $R_{12}$, it is preferred that $R_{15}$ is a methyl group substituted by at least one electron attractive group as represented by $R_1$ and $R_2$ (for example, cyanomethyl, methoxycarbonylmethyl and ethoxycarbonylmethyl).

$T_2$ represents a timing group utilizing an intramolecular nucleophilic displacement reaction as described in U.S. Pat. Nos. 4,248,962, 4,861701, 4,857,440, and 4,847,185, and JP-A-57-56837 (The term "JP-A" as used herein means an "unexamined published Japanese Patent application); or a timing group utilizing an electron transfer reaction along a conjugated chain as described in JP-A-56-114946, JP-A-57-154234 and JP-A-57-188035. $m_1$, $m_2$ and $m_3$ each represents 0 or 1. In the present invention, $-(T)_n-$ is preferably $-CO_2-$.

ED represents a group which can be released from the coupler for use in the present invention or the above-mentioned T to undergo a redox reaction with an oxidized color developing agent. ED is preferably represented by the following formula (6):

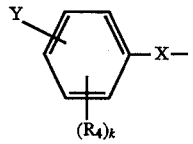
(6)

In formula (6), X represents —O— or $-N(R_{21})-$. Y represents —OH, $-N(R_{22})(R_{23})$, or $-NHSO_2R_{24}$ which is substituted at the ortho-position or para-position to X, with the proviso that, when X is $-N(R_{21})-$, Y can not be $-N(R_{22})(R_{23})$ attached to the para-position to X. $R_{21}$, $R_{22}$ and $R_{23}$ each represents a hydrogen atom, an aliphatic group preferably having 24 or less carbon atoms (for example, methyl, ethyl, propyl, isopropyl, t-butyl, t-amyl, t-octyl, tridecyl, cyclopentyl, or cyclohexyl), or an aryl group preferably having 24 or less carbon atoms (for example, phenyl, 1-naphthyl, or 2-naphthyl). $R_{24}$ represents an aliphatic group preferably having 24 or less carbon atoms (for example, methyl, ethyl, propyl, isopropyl, t-butyl, t-amyl, t-octyl, tridodecyl, cyclopentyl, or cyclohexyl) or an aryl group preferably having 24 or less carbon atoms (for example, phenyl, 1-naphthyl, or 2-naphthyl). The aliphatic groups or the aromatic groups represented by $R_{21}$, $R_{22}$, $R_{23}$, $R_{24}$ may contain additional substituents as represented by $R_3$. $R_4$ represents a substituent, and has the same meanings as $R_3$ described above. k represents 0 or an integer of 1 to 4. When k is an integer of 2 or more, $R_4$s may be the same or different, or may combine with each other to form a ring.

G represents a hydrogen atom or a blocking group which can be eliminated from the coupler on photographic processing. Examples of the blocking groups eliminated include groups which can be eliminated by hydrolysis as described in U.S. Pat. Nos. 2,575,182, 2,706685, 2,865,748, and 4,123,281 and those which can be eliminated by an intramolecular nucleophilic reaction. G is preferably a hydrogen atom.

Preferred embodiments of the present invention are shown by the following formula (7-1) or (7-2):

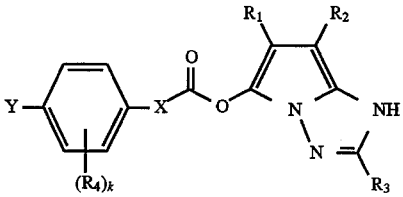

(7-1)

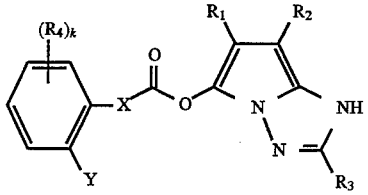

(7-2)

The preferred embodiments are more specifically shown in formula (8-1) or (8-2):

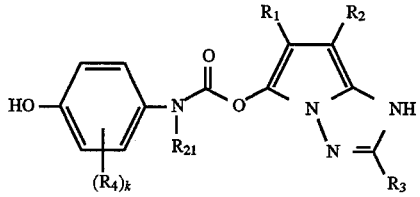

(8-1)

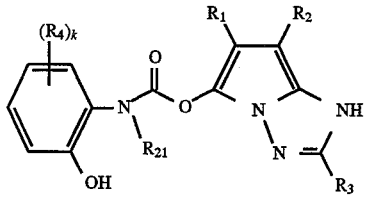

(8-2)

In formula (7-1), (7-2), (8-1) or (8-2), $R_1$ to $R_4$, $R_{21}$, X, Y and k have the same meanings as those as described above.

Among these, couplers preferred particularly are those which $R_1$ is a cyano group, $R_2$ is an aliphatic oxycarbonyl group, more preferably an aliphatic oxycarbonyl group represented by the formula (4) and $R_3$ is an aryl or alkyl group.

Examples of the compounds for use in the present invention are shown below. However, the present invention is not limited by these compounds.

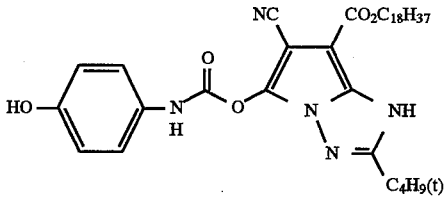

(1)

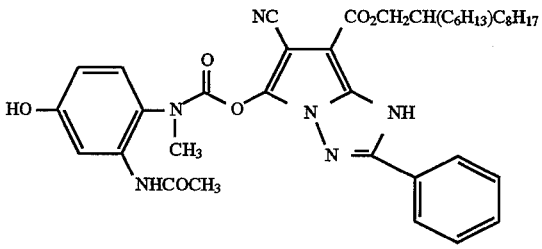

(2)

-continued
(3)
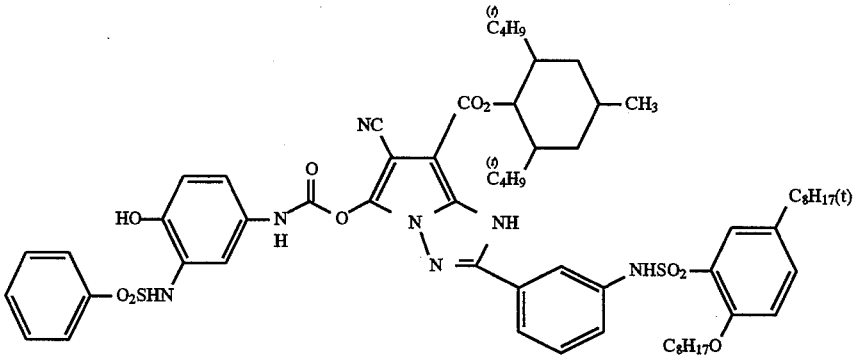
(4)
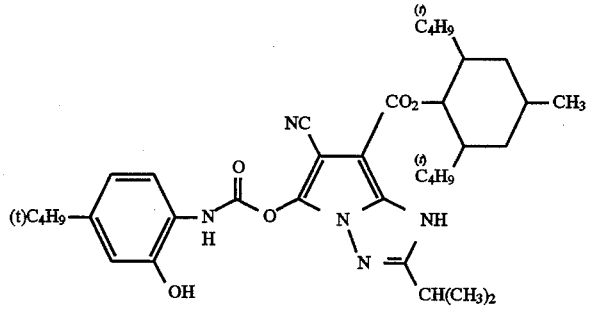
(5)
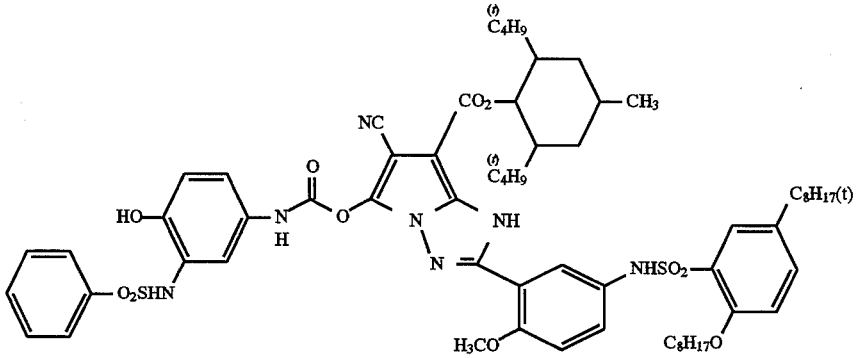
(6)
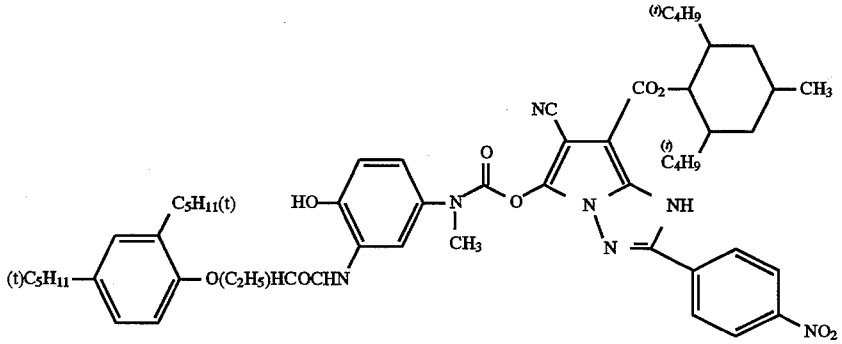

-continued
(7)
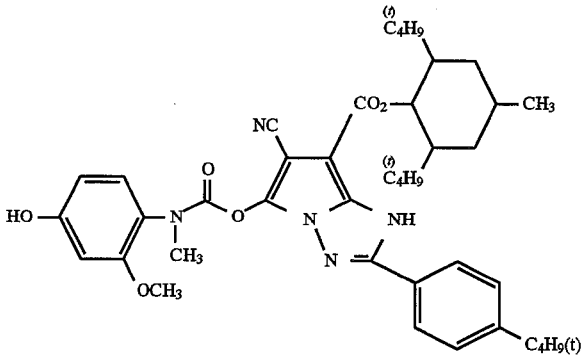
(8)
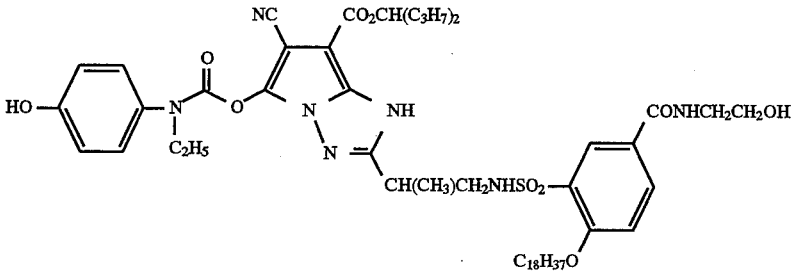
(9)
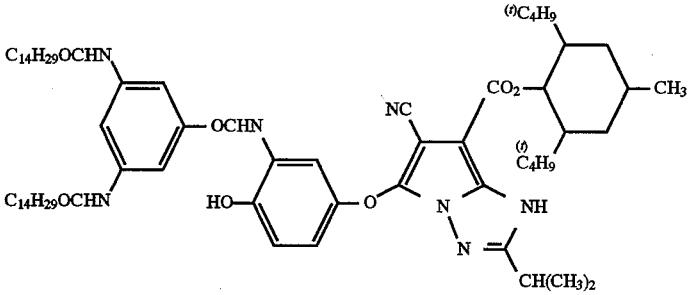
(10)
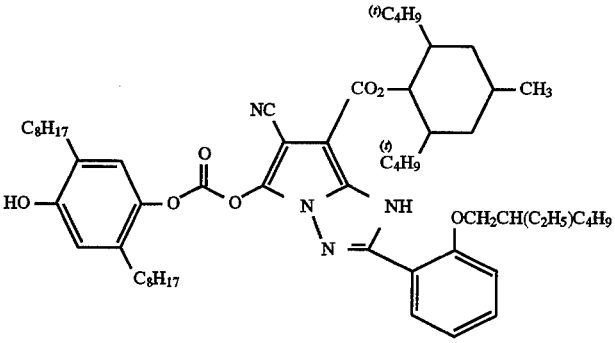
(11)
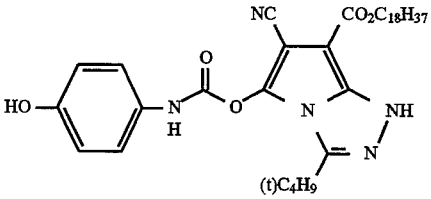

-continued
(12)
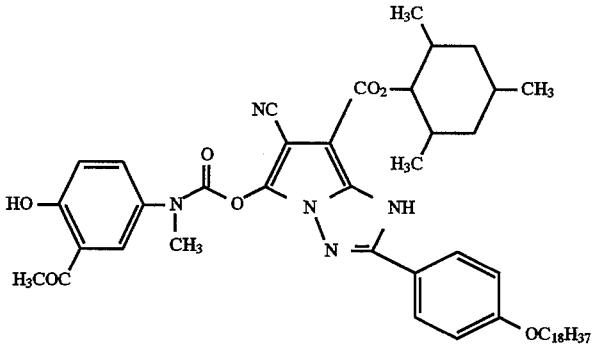
(13)
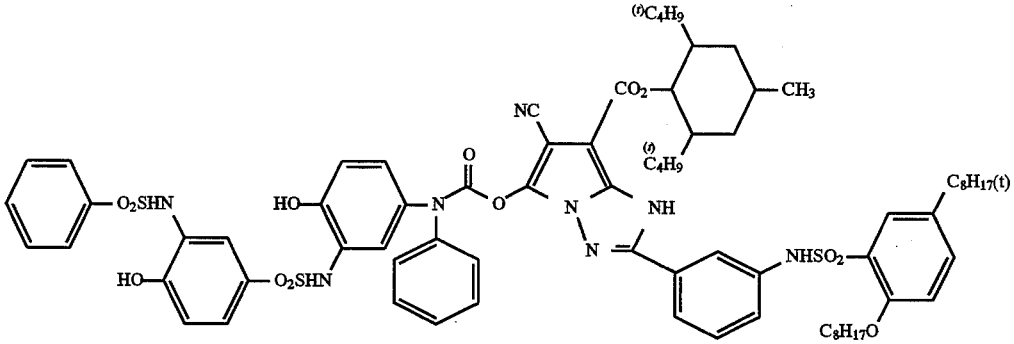
(14)
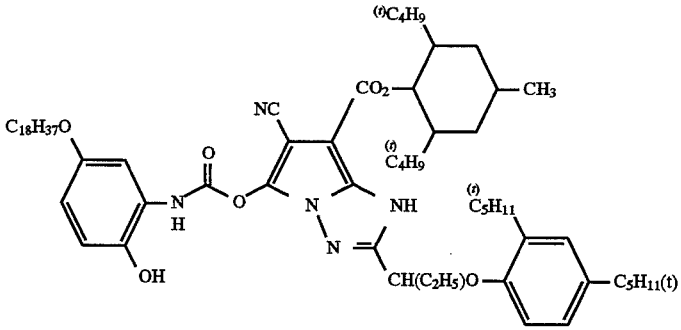
(15)
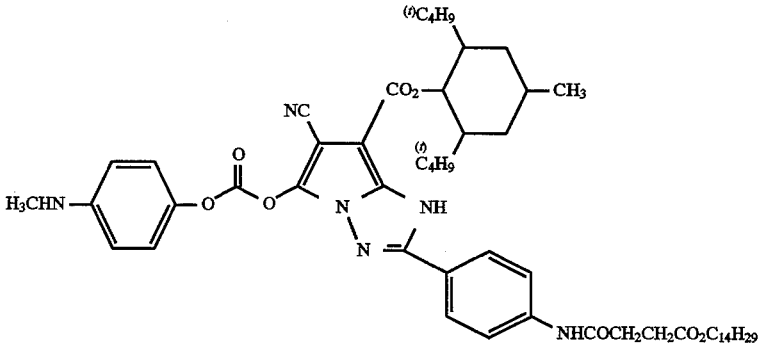

-continued
(16)
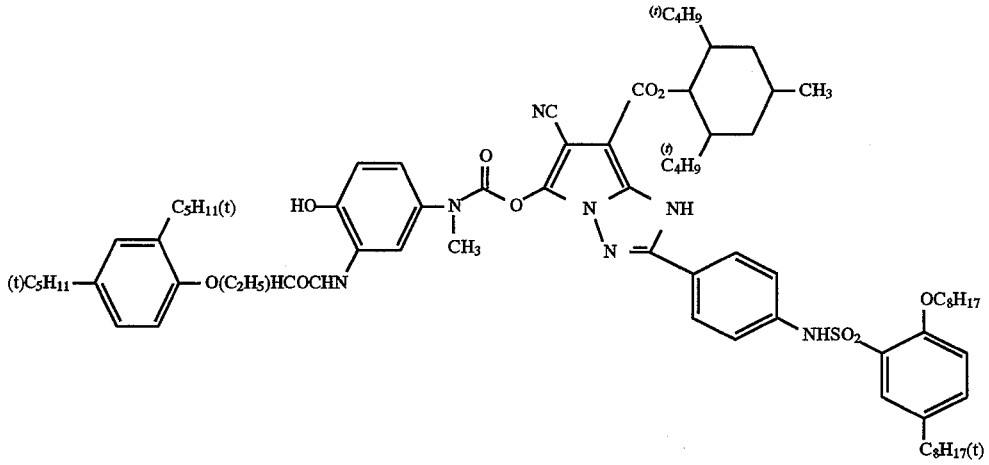
(17)
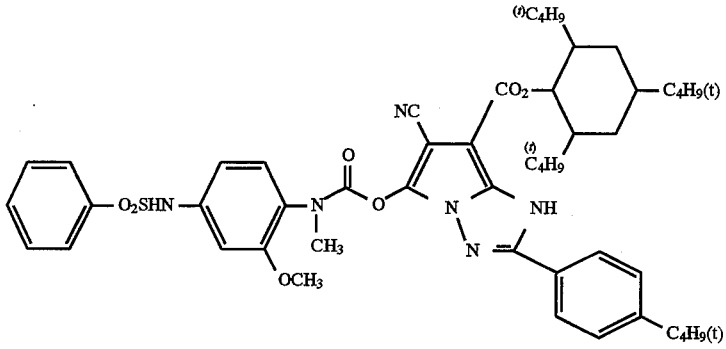
(18)
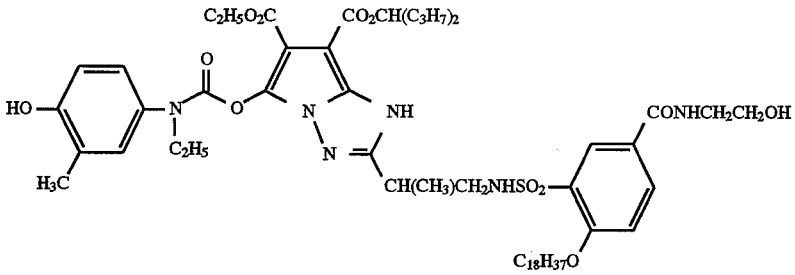
(19)
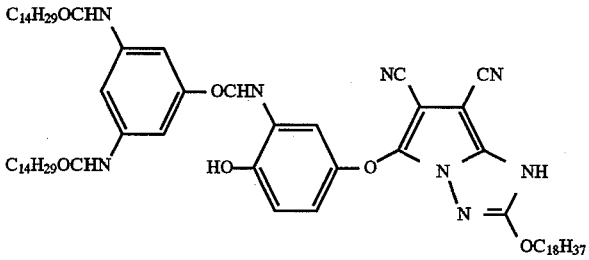

-continued
(20)
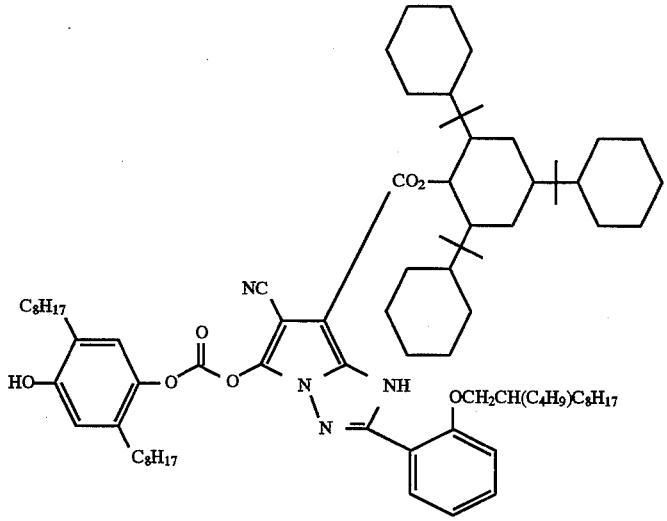
(21)
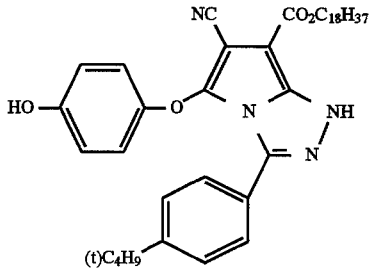
(22)
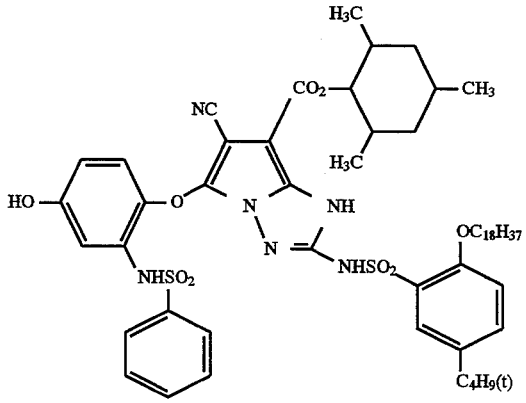
(23)
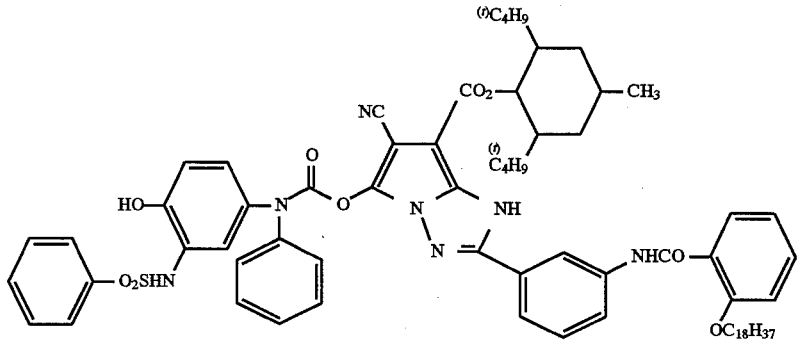

-continued
(24)
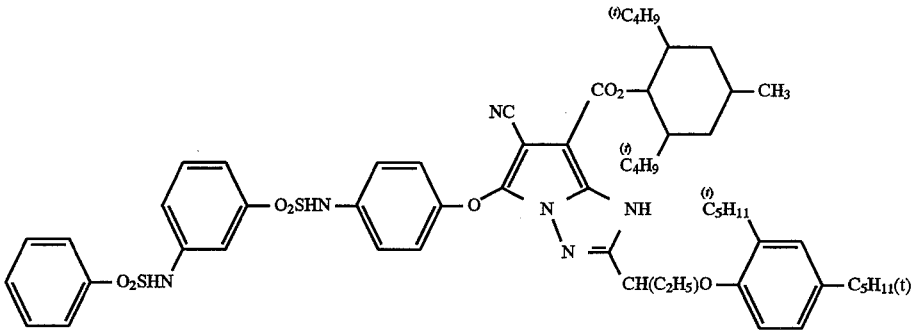
(25)
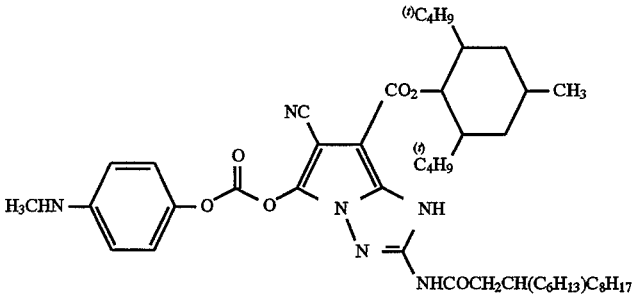
(26)
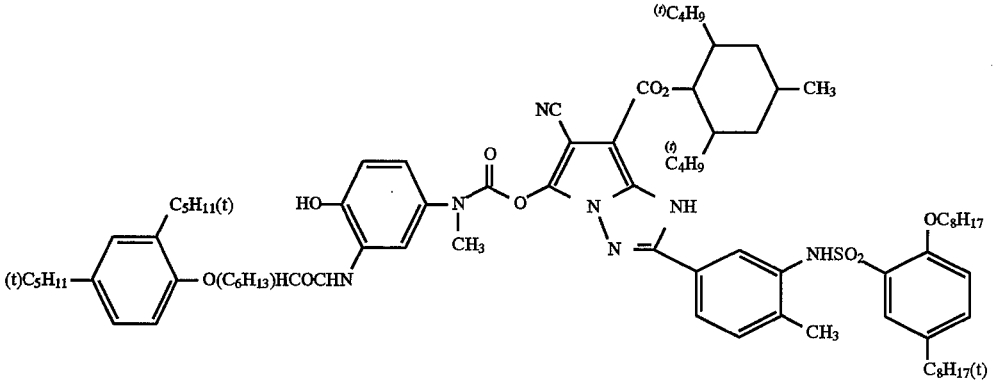
(27)
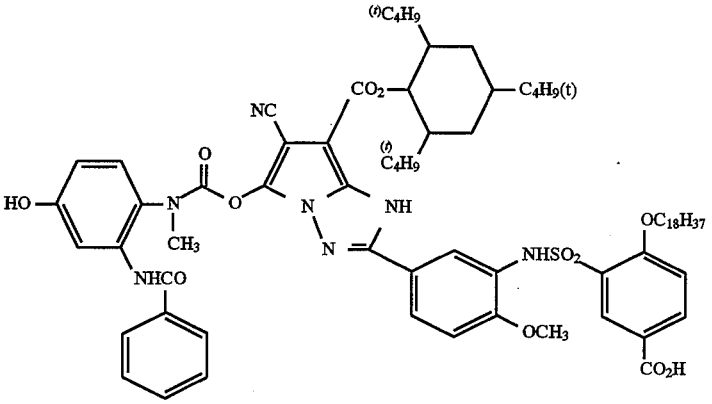

-continued
(28)
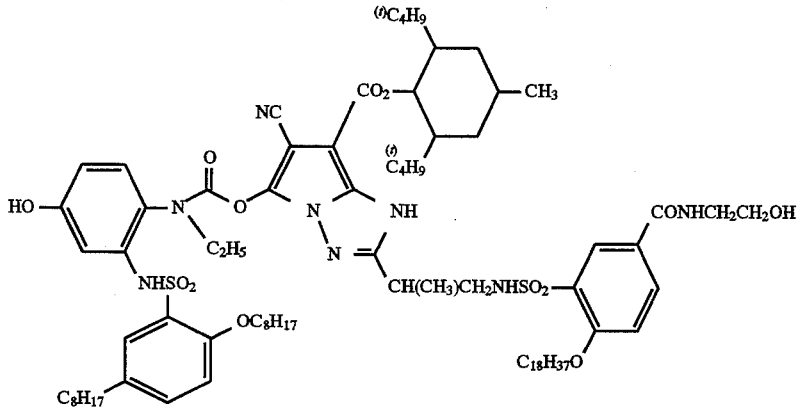
(29)
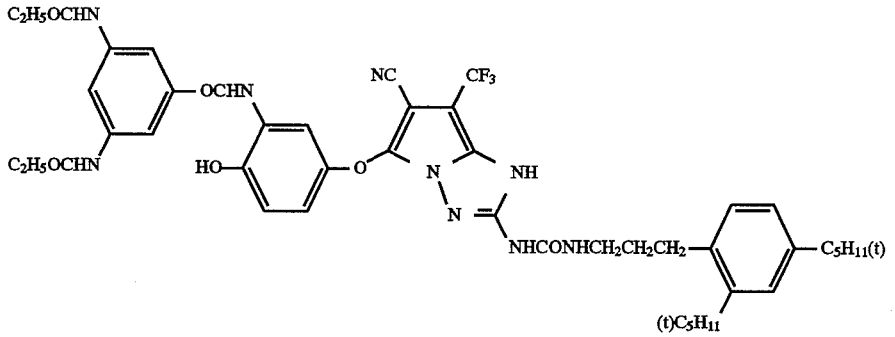
(30)
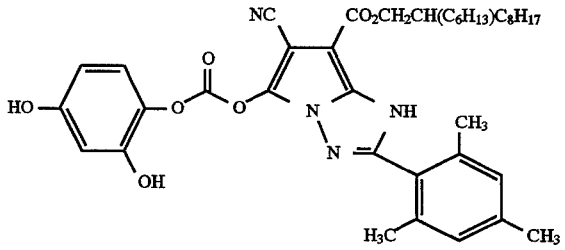
(31)
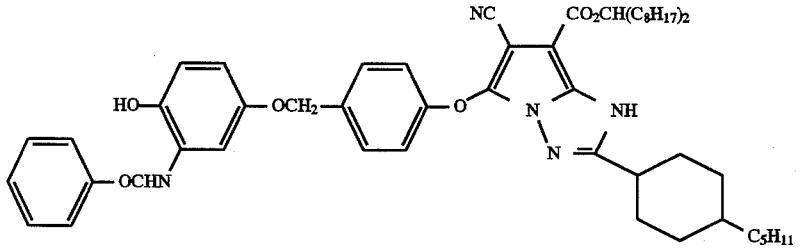
(32)
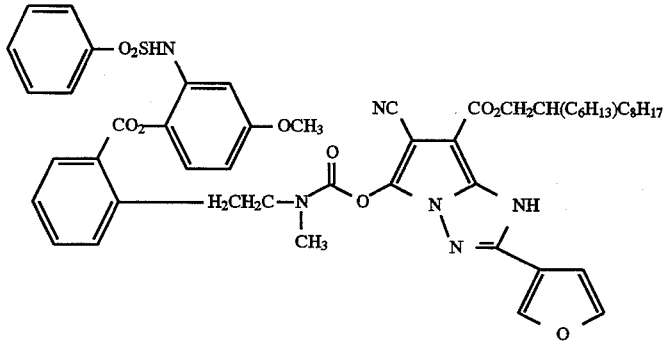

-continued
(33)
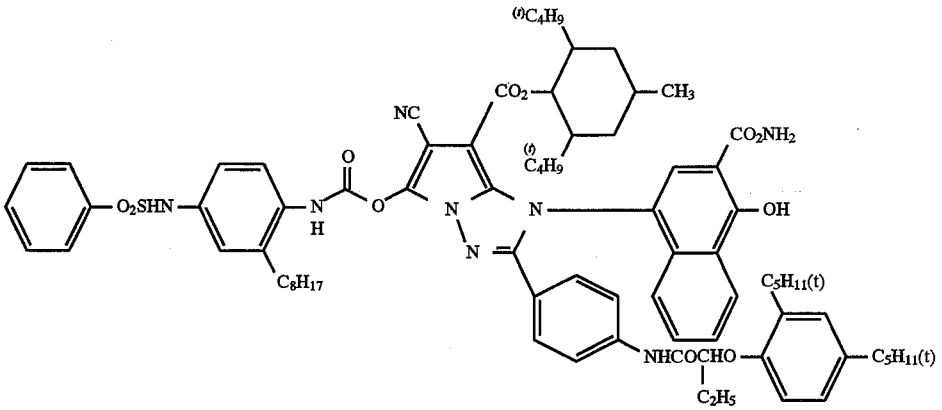
(34)
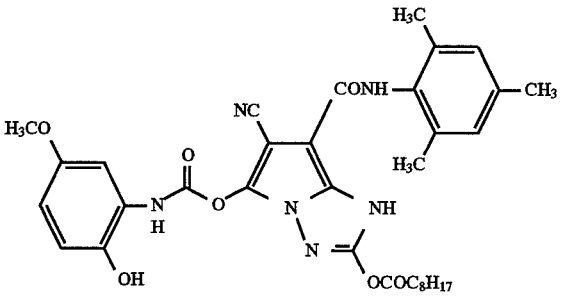
(35)
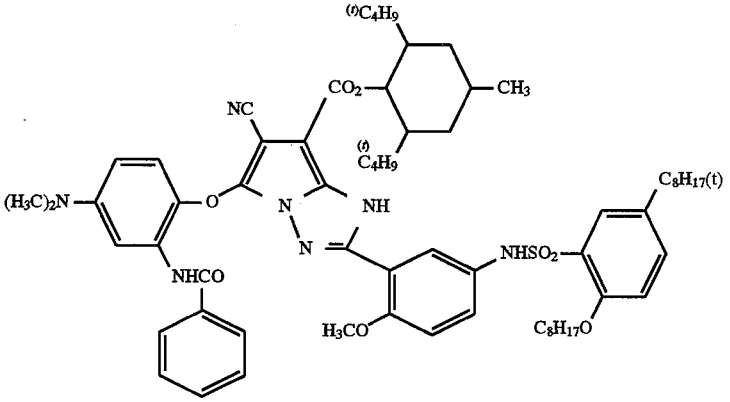
(36)
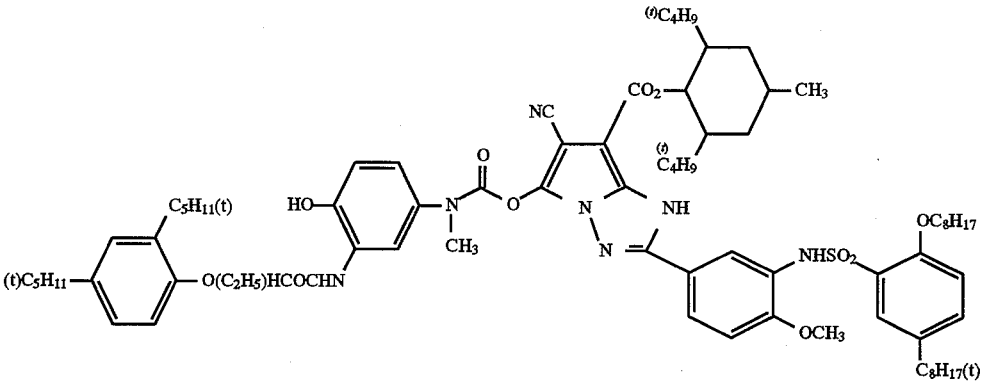

-continued
(37)
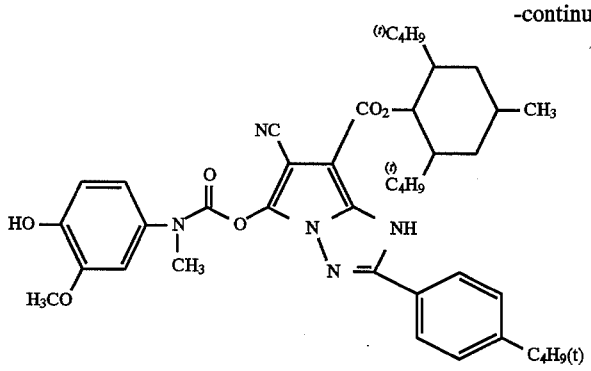
(38)
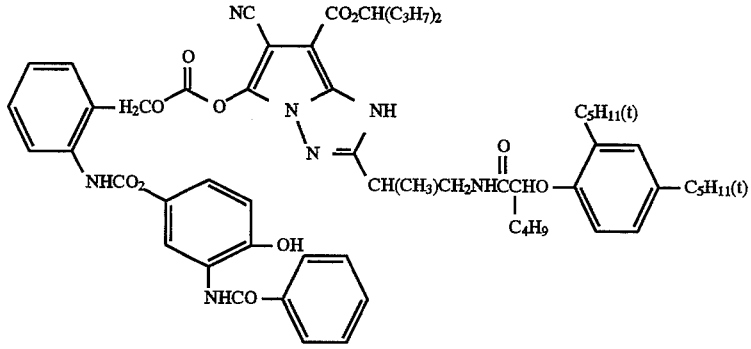
(39)
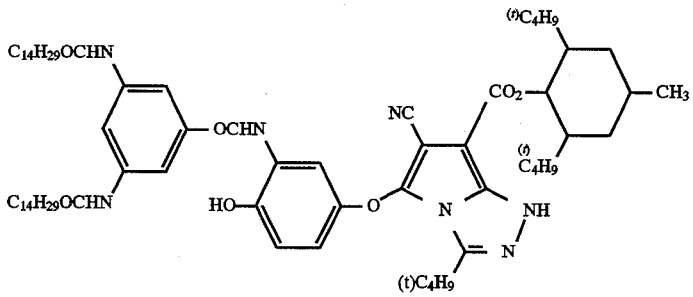
(40)
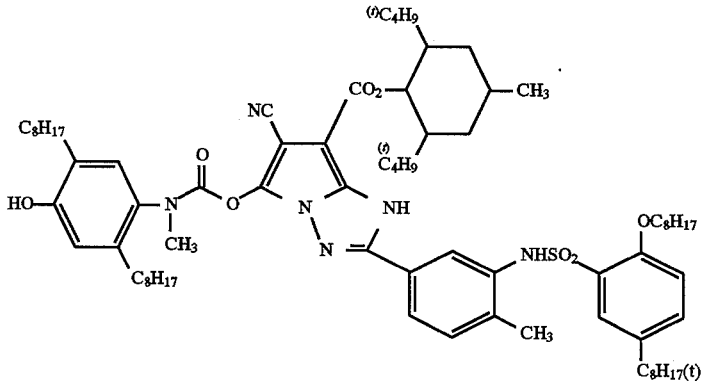
The compounds for use in the present invention can be easily prepared by a method described in JP-A-7-48376 or by similar methods to this. A synthesis example of a compound for use in the present invention is described below.
Synthesis of Compound 16
Compound 16 was prepared according to the scheme described below:

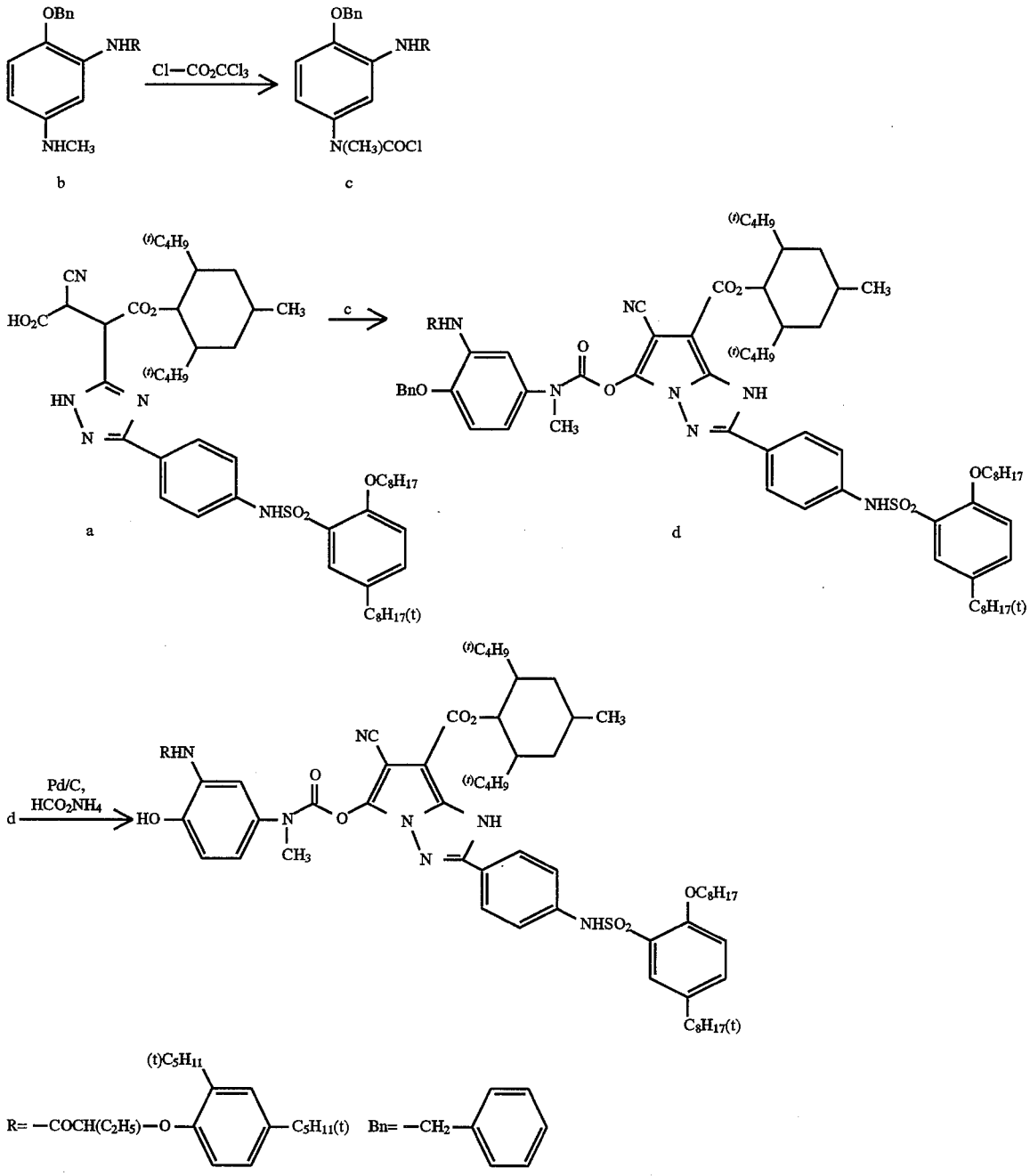

A solution of aniline b and diisopropylamine (0.91 g) in dichloromethane (10 ml) was added dropwise to a solution of trichloromethyl chloroformate (0.42 ml) in dichloromethane (10 ml) at 0° C., and the resulting mixture was stirred at 0° C. for 30 minutes to prepare a solution of carbamoyl chloride c. The solution of carbamoyl chloride c was slowly added dropwise to a pyridine (50 ml) solution of compound a (3.6 g) prepared by a method described in JP-A-7-48376, and the resulting solution was stirred at room temperature for 1 hour. The reaction mixture was poured into ethyl acetate (100 ml)/chilled diluted hydrochloric acid (100 ml), and the 2 layers were separated. The organic layer was successively washed with diluted hydrochloric acid, diluted brine (3 times) and saturated brine, dried over anhydrous sodium sulfate, and concentrated in vacuo. The residue was purified by column chromatographyto obtain compound d (3.8 g). Compound d (3.8 g), ammonium formate (10 g) and 10% Pd/C (0.5 g) was refluxed in a mixture of methanol (30 ml) and tetrahydrofuran (15 ml) for 1 hour, and the reaction mixture was subjected to Celite filtration. Ethyl acetate (100 ml) was added to the filtrate, and the mixture was successively washed with diluted hydrochloric acid, diluted brine (3 times) and saturated brine, dried over anhydrous sodium sulfate, and concentrated in vacuo. The residue was purified by column chromatography to obtain compound 16 (2.0 g). Similarly, the other compounds exemplified above also were able to be easily prepared.

It is sufficient for the photographic material of the present invention to comprise at least one layer provided on a support, said layer containing the couplers according to the present invention. The layer containing the couplers for use in the present invention may be a hydrophilic colloidal layer. General photographic materials can be constituted of at least one blue sensitive silver halide emulsion layer, at least one green sensitive silver halide emulsion layer and at least one red sensitive silver halide emulsion layer, which are applied to the support in this order. These layers may be arranged in order different from this. Further, an infrared ray-sensitive silver halide emulsion layer can also be used in place of at least one of the above-mentioned layers. To perform color reproduction by the subtractive process, silver halide emulsions having sensitivity in the respective wavelength regions and color couplers capable of forming dyes having colors complementary to colors of light to which the layers are sensitive are contained in these sensitive emulsion layers, with the proviso that the above-mentioned correspondence of the sensitive emulsion layers with hues generated by color couplers is not necessarily indispensable. In the present invention, it is particularly preferred that the cyan couplers are incorporated into the red sensitive silver halide emulsion layer.

The content of the couplers for use in the present invention in the photographic material is suitably from $1\times10^{-3}$ to 1 mole, and preferably from $2\times10^{-3}$ to $3\times10^{-1}$ mole per mole of silver halide in layer.

Although the couplers for use in the present invention can be introduced into the photographic material by various known dispersion processes, an oil in water dispersion process is preferably used, in which the couplers dissolved in high boiling organic solvents (used together with low boiling organic solvents as needed) are emulsified and dispersed into a gelatin solution, and added to silver halide emulsions.

Examples of the high boiling solvents used for the oil in water dispersion process are described in U.S. Pat. No. 2,322,027 and so forth. Steps, effects, and examples of impregnating latexes in a latex dispersion process, one of polymer dispersion processes, are described in U.S. Pat. No. 4,199,363, West German Patent Application (OLS) Nos. 2,541,274 and 2,541,230, JP-B-53-41091 (The term "JP-B" as used herein means an "examined Japanese patent publication"), EP-A-029104, and so forth. A dispersion process by use of organic solvent-soluble polymers is described in PCT International Publication No. W088/00723. Examples of the high boiling organic solvents usable for the above-mentioned oil in water dispersion process include phthalates (for example, dibutyl phthalate, dioctyl phthalate, dicyclohexyl phthalate, di-2-ethylhexyl phthalate, decyl phthalate, bis(2,4-di-tert-amylphenyl) isophthalate, and bis(1,1-diethylpropyl) phthalate); phosphates and phosphonates (for example, diphenyl phosphate, triphenyl phosphate, tricresyl phosphate, 2-ethylhexyl diphenyl phosphate, dioctyl butyl phosphate, tricyclohexyl phosphate, tri-2-ethylhexyl phosphate, tridodecyl phosphate, di-2-ethylhexyl phenyl phosphate); benzoates (for example, 2-ethylhexyl benzoate, dodecyl benzoate, 2-ethylhexyl p-hydroxybenzoate); amides (for example, N,N-diethyldodecanamide and N,N-diethyllaurylamide); alcohols and phenols (for example, isostearyl alcohol and 2,4-di-tert-amylphenol); aliphatic esters (for example, dibutoxyethyl succinate, di-2-ethylhexyl succinate, 2-hexyldecyl tetradecanate, tributyl citrate, diethyl azelate, isostearyl lactate, and trioctyl citrate); aniline derivatives (for example, N,N-dibutyl-2-butoxy-5-tert-octylaniline), chlorinated paraffins (the chlorine content: 10 to 80%); trimesates (for example, tributyl trimesate); dodecylbenzene; diisopropylnaphthalene; phenols (for example, 2,4-di-tert-amylphenol, 4-dodecyoxyphenol,4-dodecyloxycarbonylphenol, and 4-(4-dodecyloxyphenylsulfonyl)phenol); carboxylic acids (for example, 2-(2,4-di-tert-amylphenoxy)butyric acid and 2-ethoxyoctadecanoic acid); alkyl phosphates (for example, di-2-ethylhexyl phosphate and diphenyl phosphate); and sulfonamide type compounds described in JP-A-6-258803 and EP-A-606659. These high boiling organic solvents may be used singly or as mixtures of two or more kinds thereof. Further, organic solvents having boiling points of 30° to about 160° C. (for example, ethyl acetate, butyl acetate, ethyl propionate, methyl ethyl ketone, cyclohexanone, 2-ethoxyethyl acetate, and dimethylformamide) may be used as auxiliary solvents together with the high boiling organic solvents.

The amounts of the high boiling organic solvents used are from 0 to 10.0 times, preferably from 0 to 5.0 times, and more preferably from 0.5 to 4.5 times in weight, based on the couplers used.

The silver halide emulsions, other materials (for example, additives), and photographic constituent layers (for example, layer arrangement) applied to the present invention, and processing processes and additives for processing to be applied to the photographic material are described in EP-A-0355660, JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2 -93641, JP-A-6-43611, JP-A-6-3779, JP-A-6-208196, JP-A-6-118546, EP-A-0520457, *Research Disclosure,* No. 37038 (1995), and so forth.

In addition to these, techniques, and inorganic and organic materials used for the color photographic material of the present invention are described in the following portions of EP-A-436938 and specifications cited below.

| Item | Corresponding Portion |
|---|---|
| Layer Constitution | page 146, line 34 to page 147, line 25 |
| Silver Halide Emulsion | page 147, line 26 to page 148, line 12 |
| Yellow Coupler | page 137, line 35 to page 146, line 33; and page 149, line 21 to line 23 |
| Magenta Coupler | page 149, line 24 to line 28; EP-A-421453, page 3, line 5 to page 25, line 55 |
| Cyan Coupler | page 149, line 29 to line 33; |
| Usable Together | EP-A-432804, page 3, line 28 to page 40 to line 2 |
| Polymer Coupler | page 149, line 34 to line 38; EP-A-435334, page 113, line 39 to page 123, line 37 |
| Colored Coupler | page 53, line 42 to page 137, line 34; page 149, line 39 to line 45 |
| Other Functional Couplers | page 7, line 1 to page 53, line 41; page 149, line 46 to page 150, line 3; EP-A-435334, page 3, line 1 to page 29, line 50 |
| Antibacterial and Antifungal Agents | page 150, line 25 to line 28 |
| Formalin Scavenger | page 149, line 15 to line 17 |
| Other Additives | page 153, line 38 to line 47; EP-A-421453, page 75, line 21 to page 84, line 56; page 27, line 40 to page 37, line 40 |
| Dispersing Process | page 150, line 4 to line 24 |
| Support | page 150, line 32 to line 34 |
| Layer Thickness, Layer Physical Properties | page 150, line 35 to line 49 |

-continued

| Item | Corresponding Portion |
|---|---|
| Color development, Black-and-white Development, Fogging Step | page 150, line 50 to page 151, line 47; EP-A-442323, page 34, line 11 to line 54; page 35, line 14 to line 22 |
| Desilvering Step | page 151, line 48 to page 152, line 53 |
| Automatic Processor | page 152, line 54 to page 153, line 2 |
| Washing and Stabilizing Steps | page 153, line 3 to line 37 |

The present invention is illustrated below with reference to examples in detail. However, the present invention is not limited by the examples.

EXAMPLE 1

Preparation of Sample 101:

On a undercoated 127 μm-thick cellulose triacetate film support, layers consisting of the following compositions were successively formed to prepare a multilayer color photographic material, sample 101. Numbers represent amounts coated per $m^2$. Effects of compounds added are not limited to those of uses described.

| | | |
|---|---|---|
| **The First Layer: Antihalation Layer** | | |
| Black Colloidal Layer | | 0.10 g |
| Gelatin | | 1.90 g |
| Ultraviolet Absorber U-1 | | 0.10 g |
| Ultraviolet Absorber U-3 | | 0.040 g |
| Ultraviolet Absorber U-4 | | 0.10 g |
| High Boiling Organic Solvent Oil-1 | | 0.10 g |
| Dye E-1 (finely divided crystal solid dispersion) | | 0.10.g |
| **The Second Layer: Interlayer** | | |
| Gelatin | | 0.40 g |
| Compound Cpd-C | | 5.0 mg |
| Compound Cpd-J | | 5.0 mg |
| Compound Cpd-K | | 3.0 mg |
| High Boiling Organic Solvent Oil-3 | | 0.10 g |
| Dye D-4 | | 0.80 mg |
| **The Third Layer: Interlayer** | | |
| Finely Divided Grain Silver Iodobromide Emulsion Fogged at Surface and Interior (Average Grain Size: 0.06 μm, Coefficient of Variation: 18%, AgI Content: 1 mole %) | Silver Amount | 0.050 g |
| Yellow Colloidal Silver | Silver Amount | 0.030 g |
| Gelatin | | 0.40 g |
| **The Fourth Layer: Low Speed Red Sensitive Emulsion Layer** | | |
| Emulsion A | Silver Amount | 0.45 g |
| Emulsion B | Silver Amount | 0.30 g |
| Gelatin | | 0.80 g |
| Coupler C-1 | | 0.15 g |
| Coupler C-2 | | 0.10 g |
| Coupler C-9 | | 0.010 g |
| Compound Cpd-C | | 5.0 mg |
| Compound Cpd-J | | 5.0 mg |
| High Boiling Organic Solvent Oil-2 | | 0.10 g |
| High Boiling Organic Solvent Oil-1 | | 0.05 g |
| Additive P-1 | | 0.10 g |
| **The Fifth Layer: Medium Speed Red Sensitive Emulsion Layer** | | |
| Emulsion B | Silver Amount | 0.30 g |
| Emulsion C | Silver Amount | 0.35 g |
| Gelatin | | 0.80 g |
| Coupler C-1 | | 0.07 g |
| Coupler C-2 | | 0.05 g |
| Coupler C-3 | | 0.05 g |
| High Boiling Organic Solvent Oil-2 | | 0.05 g |
| High Boiling Organic Solvent Oil-1 | | 0.05 g |
| Additive P-1 | | 0.10 g |
| **The Sixth Layer: High Speed Red Sensitive Emulsion Layer** | | |
| Emulsion D | Silver Amount | 0.30 g |
| Gelatin | | 1.10 g |
| Coupler C-1 | | 0.10 g |
| Coupler C-2 | | 0.05 g |
| Coupler C-3 | | 0.50 g |
| Additive P-1 | | 0.10 g |
| **The Seventh Layer: Interlayer** | | |
| Gelatin | | 0.80 g |
| Additive M-1 | | 0.30 g |
| Compound Cpd-I | | 2.6 mg |
| Dye D-5 | | 0.020 g |
| Dye D-6 | | 0.010 g |
| Compound Cpd-J | | 12.0 mg |
| High Boiling Organic Solvent Oil-1 | | 0.020 g |
| **The Eighth Layer: Interlayer** | | |
| Silver Iodobromide Emulsion Fogged at Surface and Interior (Average Grain Size: 0.06 μm, Coefficient of Variation: 16%, AgI Content: 0.3 mole%) | Silver Amount | 0.025 g |
| Yellow Colloidal Silver | Silver Amount | 0.010 g |
| Gelatin | | 1.00 g |
| Additive P-1 | | 0.05 g |
| Color Stain Preventing Agent Cpd-A | | 0.10 g |
| High Boiling Organic Solvent Oil-3 | | 0.10 g |
| **The Ninth Layer: Low Speed Green Sensitive Emulsion Layer** | | |
| Emulsion E | Silver Amount | 0.30 g |
| Emulsion F | Silver Amount | 0.10 g |
| Emulsion G | Silver amount | 0.20 g |
| Gelatin | | 0.50 g |
| Coupler C-4 | | 0.10 g |
| Coupler C-7 | | 0.050 g |
| Coupler C-8 | | 0.10 g |
| Compound Cpd-B | | 0.030 g |
| Compound Cpd-D | | 0.020 g |
| Compound Cpd-E | | 0.020 g |
| Compound Cpd-F | | 0.040 g |
| Compound Cpd-J | | 10 mg |
| Compound Cpd-L | | 0.02 g |
| High Boiling Organic Solvent Oil-1 | | 0.10 g |
| High Boiling Organic Solvent Oil-2 | | 0.05 g |
| **The Tenth Layer: Medium Speed Green Sensitive Emulsion Layer** | | |
| Emulsion G | Silver Amount | 0.25 g |
| Emulsion H | Silver Amount | 0.10 g |
| Gelatin | | 0.60 g |
| Coupler C-4 | | 0.070 g |
| Coupler C-7 | | 0.050 g |
| Coupler C-8 | | 0.070 g |
| Compound Cpd-B | | 0.030 g |
| Compound Cpd-D | | 0.020 g |
| Compound Cpd-E | | 0.020 g |
| Compound Cpd-F | | 0.050 g |
| High Boiling Organic Solvent Oil-2 | | 0.050 g |
| **The Eleventh Layer: High Speed Green Sensitive Emulsion Layer** | | |
| Emulsion I | Silver Amount | 0.35 g |
| Gelatin | | 1.00 g |
| Coupler C-4 | | 0.20 g |
| Coupler C-7 | | 0.10 g |
| Coupler C-8 | | 0.050 g |
| Compound Cpd-B | | 0.080 g |
| Compound Cpd-E | | 0.020 g |
| Compound Cpd-F | | 0.040 g |
| Compound Cpd-K | | 5.0 mg |
| High Boiling Organic Solvent Oil-1 | | 0.050 g |
| High Boiling Organic Solvent Oil-2 | | 0.020 g |
| **The Twelfth Layer: Interlayer** | | |
| Gelatin | | 0.60 g |
| Compound Cpd-L | | 0.05 g |

-continued

| | | |
|---|---|---|
| High Boiling Organic Solvent Oil-1 | | 0.05 g |
| The Thirteenth Layer: Yellow Filter Layer | | |
| Yellow Colloidal Silver | | |
| | Silver Amount | 0.010 g |
| Gelatin | | 1.10 g |
| Color Stain Preventing Agent Cpd-A | | 0.10 g |
| High Boiling Organic Solvent Oil-3 | | 0.05 g |
| Dye E-2 (Finely Divided Crystal Solid Dispersion) | | 0.030 g |
| Dye E-3 (Finely Divided Crystal Solid Dispersion) | | 0.020 g |
| The Fourteenth Layer: Interlayer | | |
| Gelatin | | 0.60 g |
| The Fifteenth Layer: Low Speed Blue Sensitive Emulsion Layer | | |
| Emulsion J | Silver Amount | 0.25 g |
| Emulsion K | Silver Amount | 0.30 g |
| Gelatin | | 0.80 g |
| Coupler C-5 | | 0.25 g |
| Coupler C-6 | | 0.10 g |
| Coupler C-10 | | 0.40 g |
| Compound Cpd-I | | 0.02 g |
| The Sixteenth Layer: Medium Speed Blue Sensitive Emulsion Layer | | |
| Emulsion L | Silver Amount | 0.20 g |
| Emulsion M | Silver Amount | 0.30 g |
| Gelatin | | 0.90 g |
| Coupler C-5 | | 0.10 g |
| Coupler C-6 | | 0.10 g |
| Coupler C-10 | | 0.50 g |
| The Seventeenth Layer: High Speed Blue Sensitive Emulsion Layer | | |
| Emulsion N | Silver Amount | 0.20 g |
| Emulsion O | Silver Amount | 0.20 g |
| Gelatin | | 1.20 g |
| Coupler C-5 | | 0.10 g |
| Coupler C-6 | | 0.10 g |
| Coupler C-10 | | 0.60 g |
| High Boiling Organic Solvent Oil-2 | | 0.10 g |

-continued

| | | |
|---|---|---|
| The Eighteenth Layer: The First Protective Layer | | |
| Gelatin | | 0.70 g |
| Ultraviolet Absorber U-1 | | 0.20 g |
| Ultraviolet Absorber U-2 | | 0.050 g |
| Ultraviolet Absorber U-5 | | 0.30 g |
| Color Stain Preventing Agent Cpd-A | | 0.10 g |
| Formalin Scavenger Cpd-H | | 0.40 g |
| Dye D-1 | | 0.15 g |
| Dye D-2 | | 0.050 g |
| Dye D-3 | | 0.10 g |
| High Boiling Organic Solvent Oil-3 | | 0.10 g |
| The nineteenth Layer: The Second Protective Layer | | |
| Colloidal Silver | Silver Amount | 0.10 mg |
| Finely Divided Grain Silver Iodobromide Emulsion (Average Grain Size: 0.06 μm, AgI Content: 1 mole %) | Silver Amount | 0.10 g |
| Gelatin | | 0.40 g |
| The Twentieth Layer: The Third Protective Layer | | |
| Gelatin | | 0.40 g |
| Poly(Methyl Methacrylate) (Average Grain Size: 1.5μm) | | 0.10 g |
| Copolymer of Methyl Methacrylate with Acrylic Acid (4:6) (Average Grain Size: 1.5 μm) | | 0.10 g |
| Silicone Oil | | 0.030 g |
| Surfactant W-1 | | 3.0 mg |
| Surfactant W-2 | | 0.030 g |

In addition to the above-mentioned compositions, additives F-1 to F-8 were added to all the emulsion layers. Further, gelatin hardener H-1 and surfactants W-3, W-4, W-5, and W-6 for coating and emulsification also were added to all the layers. Furthermore, phenol, 1,2-benzisothiazolin-3-one, 2-phenoxyethanol, phenetyl alcohol, and p-hydroxybutyl benzoate also were added as antibacterial and antifungal agents.

The silver iodobromide emulsions used for sample 101 are shown in Table 1.

TABLE 1

| Emulsion | Characteristics of Grain | Average Grain Size Corresponding to Sphere (μm) | Coefficient of Variation (%) | AgI Content (%) |
|---|---|---|---|---|
| A | Monodisperse Tetradecahedron Grain | 0.28 | 16 | 4.0 |
| B | Monodisperse Cubic Internal Latent Image Type Grain | 0.30 | 10 | 4.0 |
| C | Monodisperse Cubic Grain | 0.38 | 10 | 5.0 |
| D | Monodisperse Tabular Grain Average Aspect Ratio 3.0 | 0.68 | 8 | 2.0 |
| E | Monodisperse Cubic Grain | 0.20 | 17 | 4.0 |
| F | Monodisperse Tetradecahedron Grain | 0.25 | 16 | 4.0 |
| G | Monodisperse Cubic Internal Latent Image Type Grain | 0.40 | 11 | 4.0 |
| H | Monodisperse Cubic Grain | 0.50 | 9 | 3.5 |
| I | Monodisperse Tabular Grain Average Aspect Ratio 5.0 | 0.80 | 10 | 2.0 |
| J | Monodisperse Cubic Grain | 0.30 | 18 | 4.0 |
| K | Monodisperse Tetradecahedron Grain | 0.45 | 17 | 4.0 |
| L | Monodisperse Tabular Grain Average Aspect Ratio 5.0 | 0.55 | 10 | 2.0 |
| M | Monodisperse Tabular Grain Average Aspect Ratio 8.0 | 0.70 | 13 | 2.0 |
| N | Monodisperse Tabular Grain Average Aspect Ratio 6.0 | 1.00 | 10 | 1.5 |
| O | Monodisperse Tabular Grain Average Aspect Ratio 9.0 | 1.20 | 15 | 1.5 |

TABLE 2
(Spectral Sensitization in Emulsions A to H)
| Emulsion | Sensitizing Dye Added | Amount Added to 1 Mole of Silver Halide (g) |
|---|---|---|
| A | S-2 | 0.025 |
| | S-3 | 0.25 |
| | S-8 | 0.010 |
| B | S-1 | 0.010 |
| | S-3 | 0.25 |
| | S-8 | 0.010 |
| C | S-1 | 0.010 |
| | S-2 | 0.010 |
| | S-3 | 0.25 |
| | S-8 | 0.010 |
| D | S-2 | 0.010 |
| | S-3 | 0.10 |
| | S-8 | 0.010 |
| E | S-4 | 0.50 |
| | S-5 | 0.10 |
| F | S-4 | 0.30 |
| | S-5 | 0.10 |
| G | S-4 | 0.25 |
| | S-5 | 0.08 |
| | S-9 | 0.05 |
| H | S-4 | 0.20 |
| | S-5 | 0.060 |
| | S-9 | 0.050 |
TABLE 3
(Spectral Sensitization in Emulsions I to O)
| Emulsion | Sensitizing Dye Added | Amount Added to 1 Mole of Silver Halide (g) |
|---|---|---|
| I | S-4 | 0.30 |
| | S-5 | 0.070 |
| | S-9 | 0.10 |
| J | S-6 | 0.050 |
| | S-7 | 0.20 |
| K | S-6 | 0.05 |
| | S-7 | 0.20 |
| L | S-6 | 0.060 |
| | S-7 | 0.22 |
| M | S-6 | 0.050 |
| | S-7 | 0.17 |
| N | S-6 | 0.040 |
| | S-7 | 0.15 |
| 0 | S-6 | 0.060 |
| | S-7 | 0.22 |
C-1
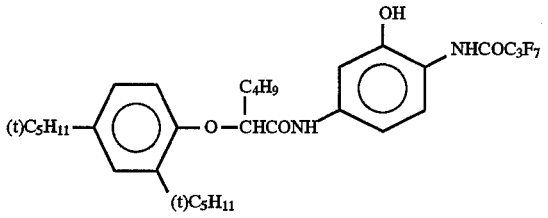
C-2
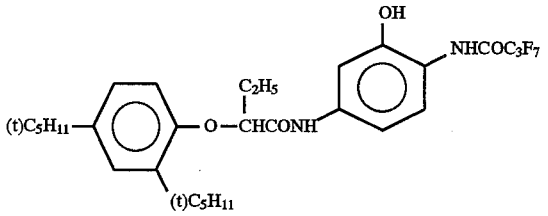
C-3
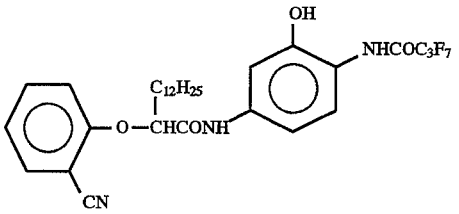

-continued
Average Molecular Weight: about 25,000
C-4
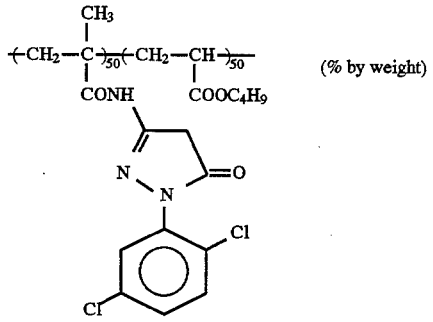
(% by weight)
C-5
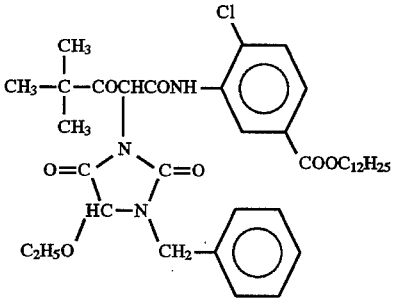
C-6
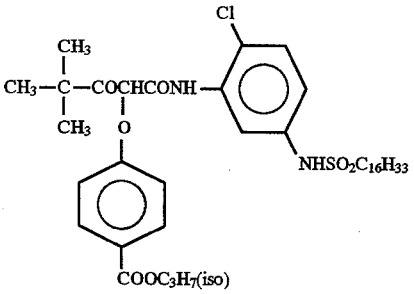
C-7
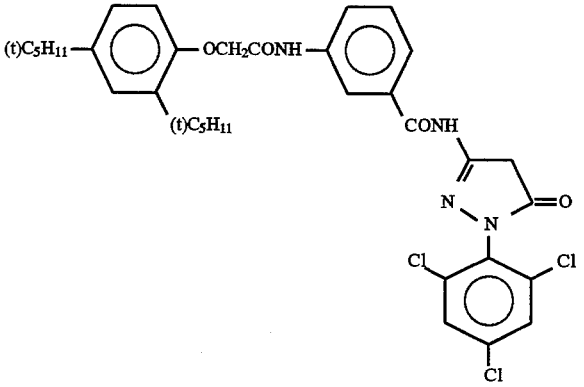
C-8
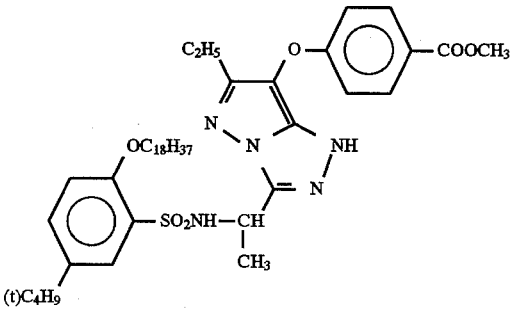

-continued
C-9
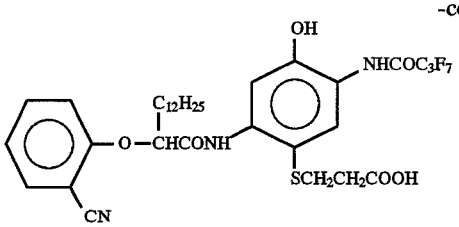
C-10
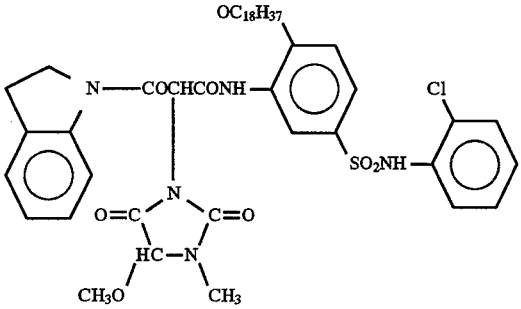
Dibutyl Phthalate — Oil-1
Tricresyl Phosphate — Oil-2
Oil-3
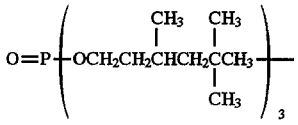
Cpd-A
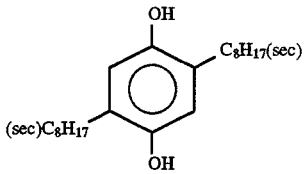
Cpd-B
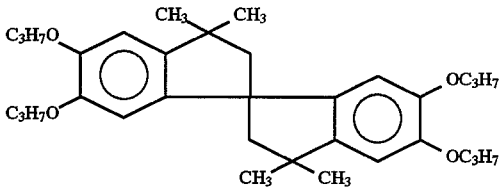
Cpd-C
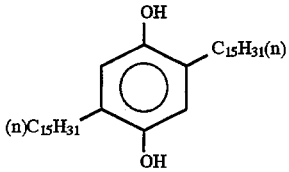
Cpd-D
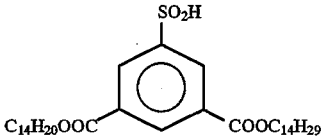
Cpd-E
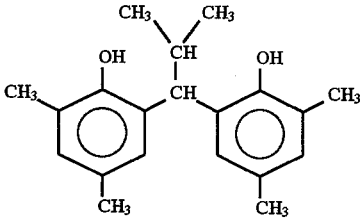

-continued
Cpd-F
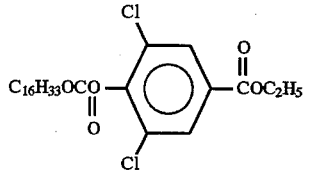
Cpd-H
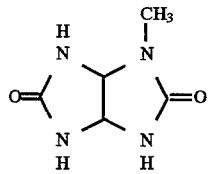
Cpd-I
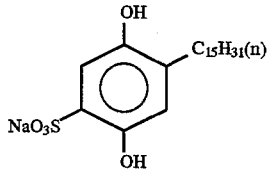
Cpd-J
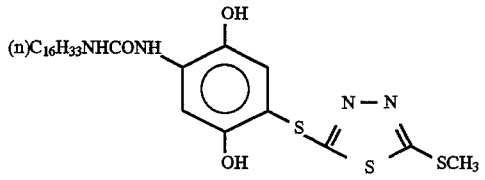
Cpd-K
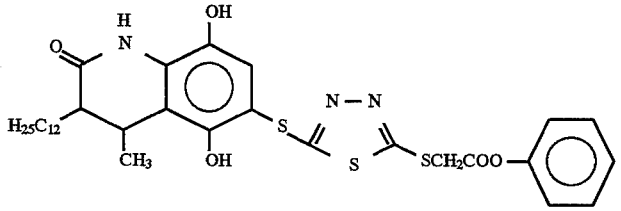
Cpd-L
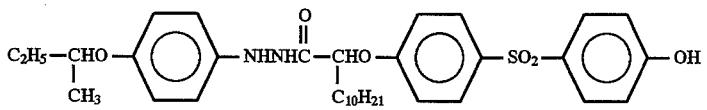
U-1
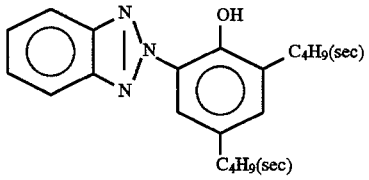
U-2
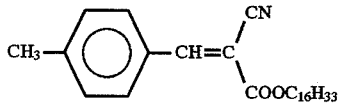
U-3
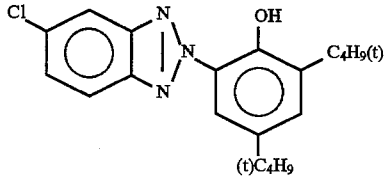

-continued
U-4
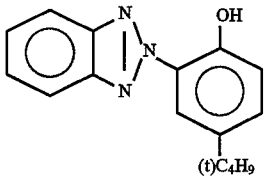
U-5
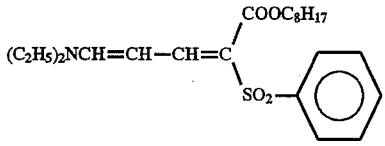
S-1
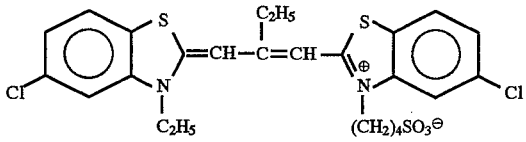
S-2
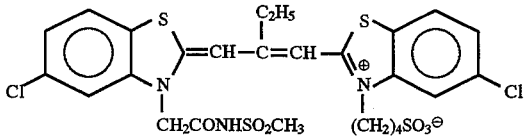
S-3
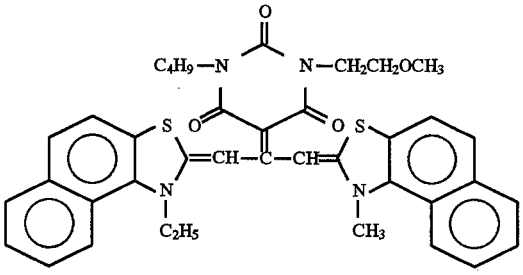
S-4
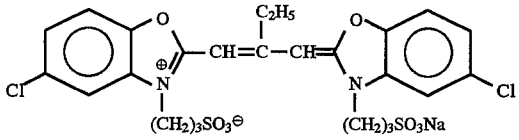
S-5
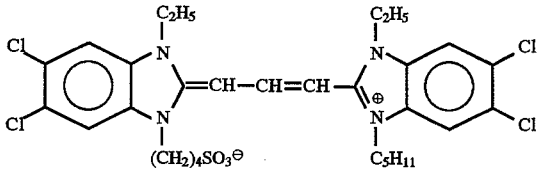
S-6
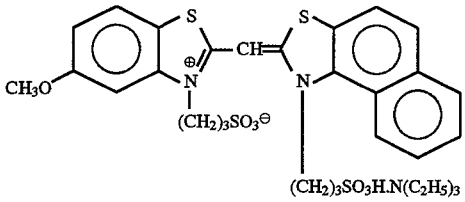
S-7
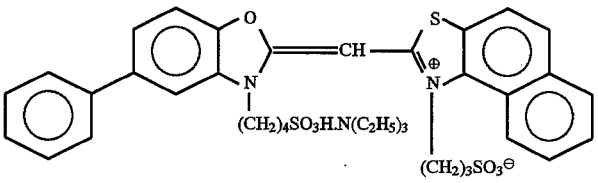

-continued
S-8
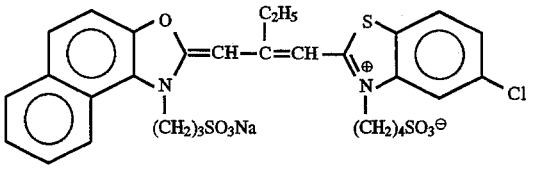
S-9
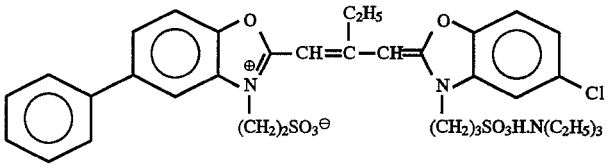
D-1
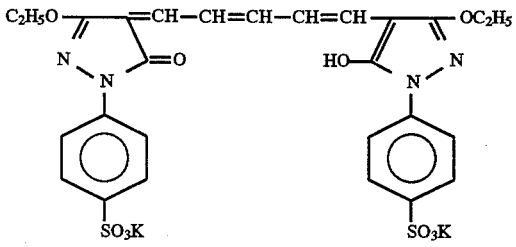
D-2
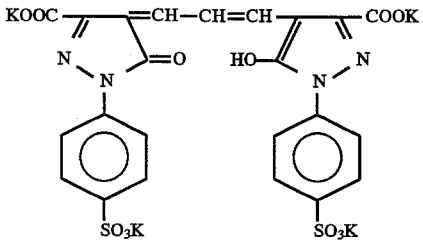
D-3
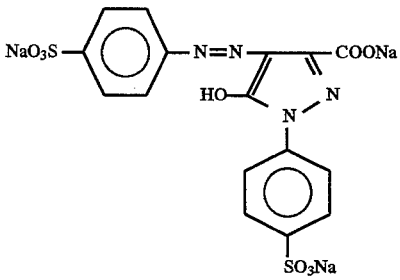
D-4
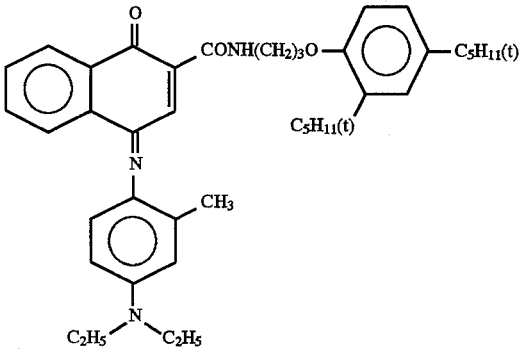

-continued
D-5
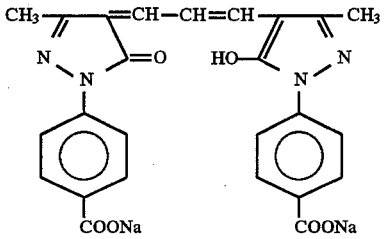
D-6
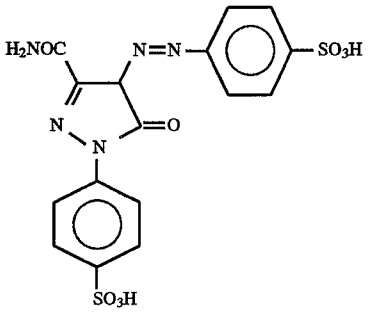
E-1
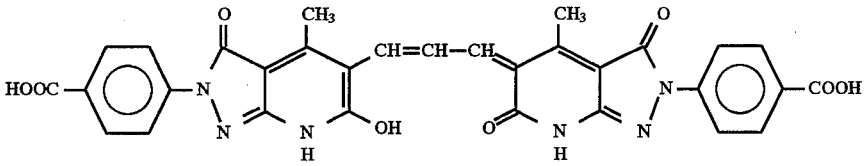
E-2
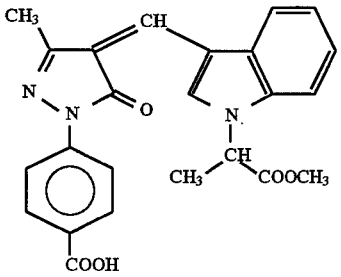
E-3
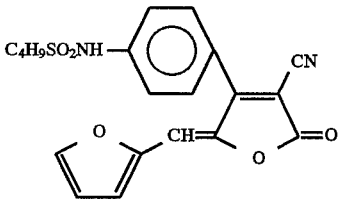
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2\overset{\oplus}{N}(CH_3)_3$
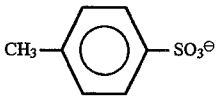
W-2
$C_8F_{17}SO_2N(C_3H_7)CH_2COOK$
W-3
$NaO_3S{-}CH(CH_2COOCH_2CH(C_2H_5)C_4H_9){-}COOCH_2CH(C_2H_5)C_4H_9$ -continued
W-4
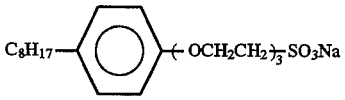
W-5
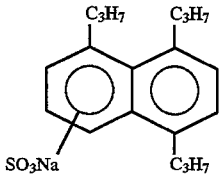
W-6
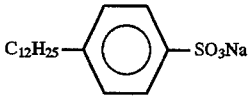
P-1
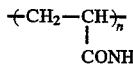
M-1
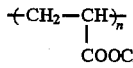
F-1
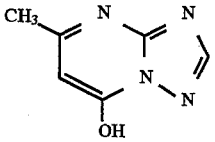
F-2
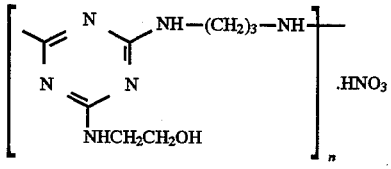
(n = 3–4)
F-3
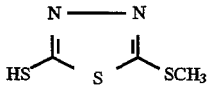
F-4
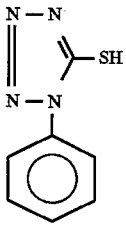
F-5
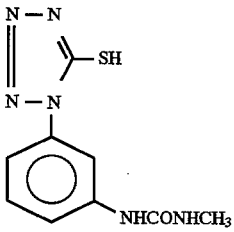
F-6
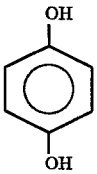

-continued

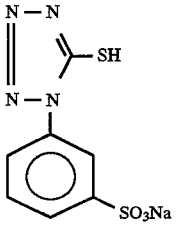

F-7

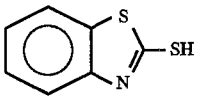

F-8

Preparation of Dispersion of Organic Solid Disperse Dye

Dye E-1 was dispersed in the following manner. Water and 200 g of an ethylene oxide-propylene oxide block copolymer (Pluronic F88 manufactured by BASF AG were added to 1,430 g of a wet cake of the dye containing 30% of methanol and the mixture was stirred to prepare a 6% slurry of the dye. Subsequently, ultraviscomill UVM-2 (manufactured by Aimex Corp.) was filled with 1,700 ml of zirconia beads having an average particle size of 0.5 mm, and the slurry was allowed to pass through it to be pulverized at a peripheral speed of about 10 m/second and a solution flow volume of 0.5 liter/minute for 8 hours. The beads were filtered out, and the filtrate was diluted with water to prepare a 3% slurry of the dye, which was then heated at 90° C. for 10 hours for stabilization. The finely divided dye thus prepared had an average particle size of 0.60 μm, and breadth of the distribution of the particles (standard deviation of grain size×100/average grain size) was 18%.

Similarly, solid dispersions of dyes E-2 and E-3 were prepared. The average grain sizes thereof were 0.54 μm and 0.56 μm, respectively.

Samples 102 to 110 were prepared in a similar manner, except that couplers shown in Table 4 were used in place of C-1, C-2 and C-3 added to the fourth to sixth layers of sample 101, with the proviso that the amounts of pyrroloazole couplers to be added to each of the layers were 45 mole % of the total amounts of C-1, C-2 and C-3 added to each of the layers of sample 101.

Interlayer A was formed between the fourth layer and the fifth layer, and interlayer B between the fifth layer and the sixth layer. The composition of both interlayers A and B are as follows.

| Interlayer A and B | |
|---|---|
| Gelatin | 0.40 g |
| High Boiling Organic Solvent Oil-1 | 0.10 g |
| Compound Cpd-A | 0.05 g |

Similarly to the other layers, the surfactants also were herein used.

TABLE 4

| Sample | The Fourth Layer | Interlayer A | The Fifth Layer | Interlayer B | The Sixth Layer | Note |
|---|---|---|---|---|---|---|
| 102 | Comparative Coupler-1 | — | Comparative Coupler-1 | — | Comparative Coupler-1 | Comparative Example |
| 103 | Comparative Coupler-2 | — | Comparative Coupler-2 | — | Comparative Coupler-2 | Comparative Example |
| 104 | (3) | — | (27) | — | (23) | Present Invention |
| 105 | (5) | — | (14) | — | (1) | Present Invention |
| 106 | (26) | — | (36) | — | (40) | Present Invention |
| 107 | Comparative Coupler-2 | Formed | Comparative Coupler-2 | Formed | Comparative Coupler-2 | Comparative Example |
| 108 | Comparative Coupler-2 | Formed | Comparative Coupler-2 | Formed | Comparative Coupler-1 | Comparative Example |
| 109 | (3) | — | (27) | Formed | Comparative Coupler-1 | Present Invention |
| 110 | (5) | Formed | (36) | — | Comparative Coupler-2 | Present Invention |

Comparative Coupler-1

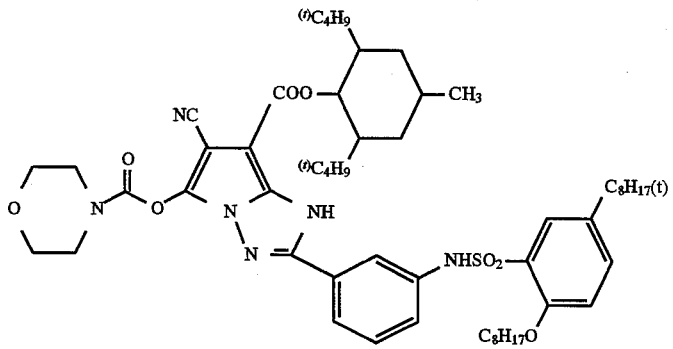

Comparative Coupler-2

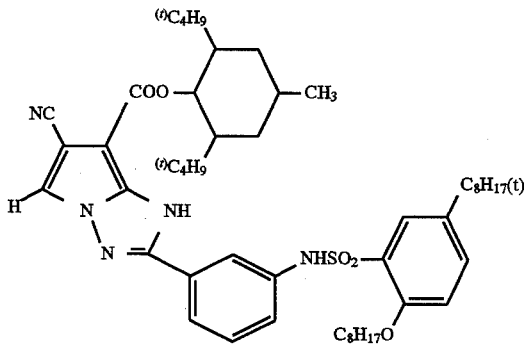

Evaluation of Color Reproduction: A color checker chart manufactured by McBeth Corp. was photographed by use of samples 101 to 110 to evaluate color reproduction. On photographing, every sample was subjected to color balance adjustment by use of color filters. Five experts who participated in image evaluation in Ashigara Laboratory of Fuji Photo Film Co., Ltd. rated turbidity and saturation of green and bluish green of the samples on scale of 1 to 5 per capita to show the result of evaluation with total marks. The less the turbidity, the higher is the evaluation. The higher the saturation, the higher is the evaluation.

Measurement of Sensitivity: Samples 101 to 110 were exposed to white light of a color temperature of 4,800° through a wedge having continuously changing density, and were subjected to processing described below to measure sensitivity $S_{R1.0}$ giving a cyan density of 1.0. The sensitivity higher than $S_{R1.0}$ of comparative example 101 was indicated as a positive value. The result is shown in Table 5.

Evaluation of Graininess: Samples 101 to 110 were subjected to stepwise exposure by use of the white light, and processed as described below. RMS granularity values of the samples were then measured. The measuring aperture was 48 μmϕ. Measured values multiplied by 1,000 are shown.

Evaluation of Sharpness: Samples 101 to 110 were exposed to the white light through a modulation transfer function (MTF) pattern, and processed as described below. MTF values of cyan images (10 cycles/m) were determined to compare sharpness of the samples with one another. The result of evaluation is indicated by ratios (MTF ratios) based on the MTF value of sample 101 assumed to be 1.0.

All results of the above-described evaluation are shown in Table 5.

TABLE 5

(Results of Evaluation)

| Sample | Color Reproduction (on a Scale of 1 to 25) | Sensitivity $\Delta S_{R1.0}$ | RMS Granularity Value (x 1,000) Areas of Cyan Density of 0.5 | MTF Ratio (10 cycles/mm) | Note |
|---|---|---|---|---|---|
| 101 | 16 | 0.00 (Standard) | 7.0 | 1.00 (Standard) | CE*1 |
| 102 | 20 | −0.43 | 11.0 | 0.92 | CE |
| 103 | 21 | −0.28 | 9.5 | 0.93 | CE |
| 104 | 23 | 0.00 | 7.0 | 1.00 | PI*2 |
| 105 | 23 | 0.02 | 7.2 | 1.01 | PI |
| 106 | 24 | 0.02 | 7.1 | 1.01 | PI |
| 107 | 22 | −0.10 | 8.0 | 0.89 | CE |
| 108 | 22 | 0.00 | 7.5 | 0.91 | CE |
| 109 | 24 | 0.02 | 7.0 | 0.99 | PI |
| 110 | 24 | 0.05 | 7.0 | 1.00 | PI |

*1CE: Comparative Example
*2PI: Present Invention

As shown in Table 5, saturation of green and bluish green is improved in samples 102 to 110 in which pyrroloazole couplers are used, compared with sample 101 in which a phenol cyan coupler is used.

Although samples 102 and 103 exhibit sensitivity lower than sample 101, the samples for which the couplers according to the present invention are used do not exhibit sensitivity decrease and have excellent graininess. Further, the samples for which the couplers according to the present invention are used maintain good sharpness without any deterioration, compared with even samples 107 and 108 in which the graininess is improved by providing samples 102 and 103 with interlayers A and B, respectively.

The following processing was carried out in all the present examples, after sample 101, 50% of which in area was completely exposed to the white light, was allowed to pass through tanks until replenisher volumes reached 3 times tank capacities.

| Processing Step | Time (min) | Temperature (°C.) | Tank Capacity (liter) | Replenishment Rate (ml/m²) |
|---|---|---|---|---|
| First Development | 6 | 38 | 12 | 2,200 |
| First Wash | 2 | 38 | 4 | 7,500 |
| Reversal | 2 | 38 | 4 | 1,100 |
| Color Development | 6 | 38 | 12 | 2,200 |
| Prebleaching | 2 | 38 | 4 | 1,100 |
| Bleaching | 6 | 38 | 12 | 220 |
| Fixing | 4 | 38 | 8 | 1,100 |
| Second Wash | 4 | 38 | 8 | 7,500 |
| Final Rinse | 1 | 25 | 2 | 1,100 |

Compositions of these processing solutions are as follows:

| | Tank Solution | Replenisher |
|---|---|---|
| The First Developing Solution | | |
| Pentasodium Nitrilo-N,N,N-trimethylenephosphonate | 1.5 g | 1.5 g |
| Pentasodium Diethylenetriaminepentaacetate | 2.0 g | 2.0 g |
| Sodium Sulfite | 30 g | 30 g |
| Potassium Hydroquinonemonosulfonate | 20 g | 20 g |
| Potassium Carbonate | 15 g | 20 g |
| Potassium Bicarbonate | 12 g | 15 g |
| 1-Phenyl-4-methyl-4-hydroxymethyl-3-pyrazolidone | 1.5 g | 2.0 g |
| Potassium Bromide | 2.5 g | 1.4 g |
| Potassium Thiocyanate | 1.2 g | 1.2 g |
| Potassium Iodide | 2.0 mg | — |
| Diethylene Glycol | 13 g | 15 g |
| with Water | to 1,000 ml | to 1,000 ml |
| pH (adjusted with sulfuric acid or potassium hydroxide) | 9.60 | 9.60 |
| Reversal Solution | | |
| Pentasodium Nitrilo-N,N,N-trimethylenephosphonate | 3.0 g | 3.0 g |
| Stannous Chloride Dihydrate | 1.0 g | 1.0 g |
| p-Aminophenol | 0.1 g | 0.1 g |
| Sodium Hydroxide | 8 g | 8 g |
| Glacial Acetic Acid | 15 ml | 15 ml |
| with Water | to 1,000 ml | to 1,000 ml |
| pH (adjusted with acetic acid or potassium hydroxide) | 6.00 | 6.00 |
| Color Developer | | |
| Pentasodium Nitrilo-N,N,N-trimethylenephosphonate | 2.0 g | 2.0 g |
| Sodium Sulfite | 7.0 g | 7.0 g |
| Trisodium Phosphate $12H_2O$ | 36 g | 36 g |
| Potassium Bromide | 1.0 g | — |
| Potassium Iodide | 90 mg | — |
| Sodium Hydroxide | 3.0 g | 3.0 g |
| Citrazinic Acid | 1.5 g | 1.5 g |
| N-Ethyl-N-(β-methanesulfonamidoethyl)-3-methyl-4-aminoaniline 3/2 sulfate monohydrate | 11 g | 11 g |

-continued

| | Tank Solution | Replenisher |
|---|---|---|
| 3,6-Dithiaoctane-1,8-diol | 1.0 g | 1.0 g |
| with Water | to 1,000 ml | to 1,000 ml |
| pH (adjusted with sulfuric acid or potassium hydroxide | 11.80 | 12.00 |
| Prebleaching | | |
| Disodium Ethylenediaminetetraacetate Dihydrate | 8.0 g | 8.0 g |
| Sodium Sulfite | 6.0 g | 8.0 g |
| 1-Thioglycerol | 0.4 g | 0.4 g |
| Adduct of Sodium Bisulfite to Formaldehyde | 30 g | 35 g |
| with Water | to 1,000 ml | to 1,000 ml |
| pH (adjusted with acetic acid or sodium hydroxide) | 6.30 | 6.10 |
| Bleaching Solution | | |
| Disodium Ethylenediaminetetraacetate Dihydrate | 2.0 g | 4.0 g |
| Iron(III) Ammonium Ethylenediaminetetraacetato Ferrate Dihydrate | 120 g | 240 g |
| Potassium Bromide | 100 g | 200 g |
| Ammonium Nitrate | 10 g | 20 g |
| with Water | to 1,000 ml | to 1,000 ml |
| pH (adjusted with nitric acid or sodium hydroxide) | 5.70 | 5.55 |
| Fixing Solution | | |
| Ammonium Thiosulfate | 80 g | 80 g |
| Sodium Sulfite | 5.0 g | 5.0 g |
| Sodium Bisulfite | 5.0 g | 5.0 g |
| with Water | to 1,000 ml | to 1,000 ml |
| pH (adjusted with acetic acid or aqueous ammonia) | 6.60 | 6.60 |
| Stabilizer | | |
| 1,2-Benzoisothiazolin-3-one | 0.02 g | 0.03 g |
| Polyoxyethylene-p-monononylphenyl Ether (Average Degree of Polymerization: 10) | 0.3 g | 0.3 g |
| Polymaleic Acid (Average Molecular Weight: 2,000) | 0.1 g | 0.15 g |
| with Water | to 1,000 ml | to 1,000 ml |
| pH | 7.0 | 7.0 |

EXAMPLE 2

1 Support

Supports used in the present invention were prepared in the following manner. After 100 parts by weight of a commercially available polyethylene-2,6-naphthalate polymer and 2 parts by weight of Tinuvin P.326 (a ultraviolet absorber manufactured by Ciba-Geigy AG) were dried by conventional procedure, they were fused at 300° C., extruded from a T-type die, subjected to a 3.0-fold longitudinal orientation at 140° C., subsequently to a 3.0-fold crosswise orientation at 130° C., and further to thermal fixing at 250° C. for 6 seconds to obtain a 90 μm-thick PEN film. Further, a stainless core having a diameter of 20 cm was wound with a part of the film, to which thermal history was given at 110° C. for 48 hours.

2 Formation of Undercoat Layer

The above-mentioned supports were subjected to corona discharge treatment, ultraviolet discharge treatment, glow discharge treatment, and flame treatment at both the surfaces, and then coated with a undercoat solution having the following composition to form a undercoat layer on the surface exposed to higher temperature on the orientation. In the corona discharge treatment, a solid state corona treating machine model 6KVA manufactured by Pillar Corp. was employed to treat the 30 cm-wide supports at a rate of 20 m/minute. Then, the treated supports were found to be treated at 0.375 KV·A·min/$m^2$ from readings of current and voltage. On the treatment, the discharge frequency was 9.6 KHz and the gap clearance between the electrode and dielectric roll was 1.6 mm. The ultraviolet discharge treatment was carried out while heating at 75° C. In the glow discharge treatment, irradiation was conducted at 3,000 W for 30 seconds by use of a cylindrical electrode.

| | |
|---|---|
| Gelatin | 3 g |
| Distilled Water | 25 ml |
| Sodium α-Sulfo-di-2-ethylhexyl-succinate | 0.05 g |
| Formaldehyde | 0.02 g |
| Salicylic Acid | 0.1 g |
| Diacetyl Cellulose | 0.5 g |
| p-Chlorophenol | 0.5 g |
| Resorcin | 0.5 g |
| Cresol | 0.5 g |
| $(CH_2{=}CHSO_2CH_2CH_2NHCO)_2CH_2$ | 0.2 g |
| Adduct of 3 Molar-Ratio Aziridine to Trimethylolpropane | 0.2 g |
| Adduct of 3 Molar-Ratio Toluene-diisocyanate to Trimethylolpropane | 0.2 g |
| Methanol | 15 ml |
| Acetone | 85 ml |
| Formaldehyde | 0.01 g |
| Acetic Acid | 0.01 g |
| Concentrated Hydrochloric Acid | 0.01 g |

3 Formation of Backing Layer

After undercoating, an antistatic layer, a magnetic recording layer, and a slip layer having the following respective compositions were formed as backing layers on one surface of the above-mentioned support.

3-1 Formation of Antistatic Layer 3-1-1 Preparation of Conductive Fine-Grain Dispersion (Stannic Oxide-Antimony Oxide Composite Dispersion)

In 3,000 parts by weight of ethanol, 230 parts by weight of stannic chloride hydrate and 23 parts by weight of antimony trichloride were dissolved to obtain a homogeneous solution. 1N sodium hydroxide was added dropwise to the solution until the pH of the solution reached 3, thus obtaining a colloidal stannic oxide-antimony oxide coprecipitate. The coprecipitate was allowed to stand at 50° C. for 24 hours to obtain a reddish brown colloidal precipitate. The reddish brown colloidal precipitate was separated by centrifugation. To remove excess ions from the precipitate, water was added to the precipitate, and taken off by centrifugation. This operation was performed 3 times.

200 Parts by weight of the precipitate thus purified were redispersed into 1,500 parts by weight of water, and the resulting dispersion was sprayed into a calcining oven maintained at 650° C. to obtain a blue-tinged finely divided powder of stannic oxide-antimony oxide composite having an average grain size of 0.005 μm. The specific resistance of the finely divided powder was 5 Ω·cm.

A mixture of 40 parts by weight of the above-mentioned finely divided powder and 60 parts by weight of water was adjusted to pH 7.0, coarsely dispersed with an agitator, and then dispersed by use of a horizontal type sand mill (trade name: Dainomill manufactured by Willya Bachofen AG), until the dwell time reached 30 minutes. Then, the secondary aggregate had an average grain size of about 0.04 μm.

3-1-2 Formation of Conductive Layer

A dispersion having the following composition was applied so that a dried membrane thickness became 0.2 μm, and then dried at 115° C. for 60 seconds to form a conductive layer.

| | Parts by Weight |
|---|---|
| Conductive Fine-Grain Dispersion Prepared in 3-1-1 | 20 |
| Gelatin | 2 |
| Water | 27 |
| Methanol | 60 |
| p-Chlorophenol | 0.5 |
| Resorcin | 2 |
| Polyoxyethylene Nonylphenyl Ether | 0.01 |

The conductive membrane obtained had resistance of $10^{8.0}\Omega$ (100 V), and exhibited excellent antistatic property.

3-2 Formation of Magnetic Recording Layer

To 1,100 g of a magnetic material, Co-clad γ-$Fe_2O_3$, (needles having a major axis of 0.14 μm and a minor axis of 0.03 μm; specific surface 41 $m_2/g$; saturation magnetization 89 emu/g; The surface was treated with aluminum oxide and silicon oxide in respective amounts of 2% by weight to $Fe_2O_3$; coercive force 9,300 e; and a $Fe^{+2}/Fe^{+3}$ ratio 6/94), 220 g of water and 150 g of a silane coupling agent, polyoxyethylene propyl trimethoxysilane (polymerization degree 16) were added, and sufficiently kneaded for 3 hours with the aid of an open kneader. The resulting viscous liquid dispersed coarsely was allowed to stand at 70° C. for a day to remove water, and heated to 110° C. for 1 hour to prepare surface-treated magnetic particles.

The magnetic particles were further kneaded in the following formulation by the use of the open kneader.

| | |
|---|---|
| Surface-Treated Magnetic Particles Described Above | 1,000 g |
| Diacetyl Cellulose | 17 g |
| Methyl Ethyl Ketone | 100 g |
| Cyclohexanone | 100 g |

Furthermore, the resulting kneaded substance was finely dispersed at 200 rpm for 4 hours by use of a sand mill (¼ G) in the following formulation.

| | |
|---|---|
| Kneaded Substance Described Above | 100 g |
| Diacetyl Cellulose | 60 g |
| Methyl Ethyl Ketone | 300 g |
| Cyclohexanone | 300 g |

Further, diacetyl cellulose and an adduct of 3 molar-ratio toluenediisocyanate to trimethylolpropane used as a hardener, in an amount of 20 wt % based on the binder, were added to the above dispersion. The resulting liquid was diluted with a mixture of methyl ethyl ketone and cyclohexanone in the same amount so that the viscosity of the resulting liquid was about 80 cp. The magnetic recording layer was formed on the above-described conductive layer with the aid of a bar coater so that the membrane thickness was 1.2 μm, and the amount of the coated magnetic material was 62 mg/$m^2$. Particles of silica (0.3 μm) as a matting agent and alumina oxide (0.5 μm) as an abrasive were added, so that the amounts coated were 10 mg/$m^2$, respectively. Drying was performed at 115° C. for 6 minutes (All rollers and transporting devices in the drying zone were maintained at 115° C.).

When a blue filter was used in status M of X light, increment of the color density $D^B$ in the magnetic recording layer was about 0.1. In the layer, the saturation magnetization moment was 4.2 emu/$m^2$, the coercive force 9230 e, and the rectangular ratio 65%.

3-3 Formation of Slip Layer

A dispersion having the following formulation was applied so as to have the following solid contents of the compounds, and dried at 110° C. for 5 minutes to form the slip layer.

| | |
|---|---|
| Diacetyl Cellulose | 25 mg/$m^2$ |
| $C_6H_{13}CH(OH)C_{10}H_{20}COOC_{40}H_{81}$ (compound a) | 6 mg/$m^2$ |
| $C_{50}H_{101}O(CH_2CH_2O)_{16}H$ (compound b) | 9 mg/$m^2$ |

Compound a and compound b (6/9) were dissolved in xylene and propylene glycol monomethyl ether (1:1 in volume) at 105° C., and the resulting solution was poured into a 10-fold amount of propylene glycol monomethyl ether (25° C.) to prepare a finely divided dispersion. Further, the dispersion was diluted with a 5-fold amount of acetone, and then redispersed with a high-pressure homogenizer (200 atm) to make a dispersion having an average particle size of 0.01 μm, which was added to the dispersion for the formation of the slip layer. The slip layer obtained had a coefficient of dynamic friction of 0.06 (stainless hard balls having a diameter of 5 mm; load 100 g; and speed 6 cm/minute) and a coefficient of static friction of 0.07 (a clip process) to exhibit excellent characteristics. In slip characteristics of the layer with an emulsion surface described later, the coefficient of dynamic friction was 0.12.

4 Formation of Light-sensitive Layers

The same layers as those of the respective samples 101 to 110 of Example 1 were formed in a multilayer state on the side opposite to the above-described backing layer to obtain samples 201 to 210.

Samples 201 to 210 were subjected to exposure and processing in a similar manner to those of Example 1, and good results were obtained similarly to Example 1.

EXAMPLE 3

On a cellulose triacetate film support to which undercoating was applied, the respective layers having the following compositions were formed in a multilayer state to prepare a multilayer color photographic material, sample 301.

Compositions of Light-sensitive Layers

| | |
|---|---|
| Cyan Coupler: ExC | Ultraviolet Absorber: UV |
| Magenta Coupler: ExM | High Boiling Organic Solvent: HBS |
| Yellow Coupler: ExY | Gelatin Hardener: H |
| Sensitizing Dye: ExS | |

Numbers corresponding to the respective components indicate coating amounts represented by a unit g/$m^2$, and the coating amounts of silver halide are shown by amounts converted to silver. The coating amounts of sensitizing dyes are however represented by a unit mole per mole of silver halide in the same layer.

| The First Layer: Antihalation Layer | |
|---|---|
| Black Colloidal Silver | Silver 0.09 |
| Gelatin | 1.60 |
| ExM-1 | 0.12 |
| ExF-1 | $2.0 \times 10^{-3}$ |
| Solid Disperse Dye ExF-2 | 0.030 |

-continued

| | |
|---|---|
| Solid Disperse Dye ExF-3 | 0.040 |
| HBS-1 | 0.15 |
| HBS-2 | 0.02 |
| **The Second Layer: Interlayer** | |
| Silver Iodobromide Emulsion Em-13 | Silver 0.065 |
| ExC-2 | 0.04 |
| Poly(Ethyl Acrylate) Latex | 0.20 |
| Gelatin | 1.04 |
| **The Third Layer: Low Speed Red Sensitive Emulsion Layer** | |
| Silver Iodobromide Emulsion Em-1 | Silver 0.40 |
| Silver Iodobromide Emulsion Em-2 | Silver 0.20 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.15 |
| ExC-3 | 0.030 |
| ExC-4 | 0.12 |
| ExC-5 | 0.020 |
| ExC-6 | 0.010 |
| Comp-2 | 0.025 |
| HBS-1 | 0.10 |
| Gelatin | 0.87 |
| **The Fourth Layer: Medium Speed Red Sensitive Emulsion Layer** | |
| Silver Iodobromide Emulsion Em-3 | Silver 0.75 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.15 |
| ExC-2 | 0.060 |
| ExC-3 | 0.0070 |
| ExC-4 | 0.090 |
| ExC-5 | 0.015 |
| ExC-6 | 0.0070 |
| Comp-2 | 0.023 |
| HBS-1 | 0.10 |
| Gelatin | 0.75 |
| **The Fifth Layer: High Speed Red Sensitive Emulsion Layer** | |
| Silver Iodobromide Emulsion Em-4 | Silver 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| ExC-6 | 0.020 |
| ExC-7 | 0.010 |
| Comp-2 | 0.050 |
| HBS-1 | 0.22 |
| HBS-2 | 0.050 |
| Gelatin | 1.10 |
| **The Sixth Layer: Interlayer** | |
| Comp-1 | 0.100 |
| Solid Disperse Dye ExF-4 | 0.030 |
| HBS-1 | 0.050 |
| Poly(Ethyl Acrylate) Latex | 0.15 |
| Gelatin | 1.10 |
| **The Seventh Layer: Low Speed Green Sensitive Emulsion Layer** | |
| Silver Iodobromide Emulsion Em-5 | Silver 0.15 |
| Silver Iodobromide Emulsion Em-6 | Silver 0.12 |
| Silver Iodobromide Emulsion Em-7 | Silver 0.10 |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.35 |
| ExM-3 | 0.086 |
| ExY-1 | 0.015 |
| HBS-1 | 0.30 |
| HBS-3 | 0.010 |
| Gelatin | 0.73 |

-continued

| The Eighth Layer: Medium Speed Green Sensitive Emulsion Layer | |
|---|---|
| Silver Iodobromide Emulsion Em-8 | Silver 0.75 |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.80 |
| The Ninth Layer: High Speed Green Sensitive Emulsion Layer | |
| Silver Iodobromide Emulsion Em-9 | Silver 1.40 |
| ExS-4 | $3.7 \times 10^{-5}$ |
| ExS-5 | $8.1 \times 10^{-5}$ |
| ExS-6 | $3.2 \times 10^{-5}$ |
| ExC-1 | 0.010 |
| ExM-1 | 0.020 |
| ExM-4 | 0.025 |
| ExM-5 | 0.035 |
| Comp-3 | 0.040 |
| HBS-1 | 0.25 |
| Poly(Ethyl Acrylate) Latex | 0.15 |
| Gelatin | 1.33 |
| The Tenth Layer: Yellow Filter Layer | |
| Yellow Colloidal Silver | Silver 0.015 |
| Comp-1 | 0.16 |
| Solid Disperse Dye ExF-5 | 0.060 |
| Solid Disperse Dye ExF-6 | 0.060 |
| Oil Soluble Dye ExF-7 | 0.010 |
| HBS-1 | 0.60 |
| Gelatin | 0.60 |
| The Eleventh Layer: Low Speed Blue Sensitive Emulsion Layer | |
| Silver Iodobromide Emulsion Em-9 | Silver 0.15 |
| Silver Iodobromide Emulsion Em-10 | Silver 0.05 |
| ExS-7 | $8.6 \times 10^{-4}$ |
| ExC-8 | $7.0 \times 10^{-4}$ |
| ExY-1 | 0.030 |
| ExY-2 | 0.22 |
| ExY-3 | 0.50 |
| ExY-4 | 0.020 |
| Comp-2 | 0.10 |

-continued

| | |
|---|---|
| Comp-3 | $4.0 \times 10^{-3}$ |
| HBS-1 | 0.28 |
| Gelatin | 1.20 |
| The Twelfth Layer: High Speed Blue Sensitive Emulsion Layer | |
| Silver Iodobromide Emulsion Em-11 | Silver 1.05 |
| ExS-7 | $4.0 \times 10^{-4}$ |
| ExY-2 | 0.10 |
| ExY-3 | 0.10 |
| ExY-4 | 0.010 |
| Comp-2 | 0.10 |
| Comp-3 | $1.0 \times 10^{-3}$ |
| HBS-1 | 0.070 |
| Gelatin | 0.70 |
| The Thirteenth Layer: The First Protective Layer | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.8 |
| The Fourteenth Layer: The Second Protective Layer | |
| Silver Iodobromide Emulsion Em-13 | Silver 1.10 |
| H-1 | 0.40 |
| B-1 (1.7 μm in diameter) | $5.0 \times 10^{-2}$ |
| B-2 (1.7 μm in diameter) | 0.15 |
| B-3 | 0.05 |
| Comp-4 | 0.20 |
| Gelatin | 0.70 |

Further, to improve storage properties, processing properties, resistance to pressure, antifungal and antibacterial properties, antistatic properties, and coating properties, these layers suitably contain WS-1 to WS-3, B-3 to B-6, FS-1 to FS-17, iron salts, lead salts, gold salts, platinum salts, palladium salts, iridium salts, and rhodium salts.

TABLE 6

| Emulsion | Average AgI Content (%) | Coefficient of Variation Referring to AgI Content among Grains (%) | Average Grain Size Corresponding to Sphere (μm) | Coefficient of Variation Referring to Grain Size (%) | Diameter of Projected Area: Diameter Corresponding to Circle (μm) | Diameter/ Thickness Ratio |
|---|---|---|---|---|---|---|
| Em-1 | 1.7 | 10 | 0.46 | 15 | 0.56 | 5.5 |
| Em-2 | 3.5 | 15 | 0.57 | 20 | 0.78 | 4.0 |
| Em-3 | 8.9 | 25 | 0.66 | 25 | 0.87 | 5.8 |
| Em-4 | 8.9 | 18 | 0.84 | 26 | 1.03 | 3.7 |
| Em-5 | 1.7 | 10 | 0.46 | 15 | 0.56 | 5.5 |
| Em-6 | 3.5 | 15 | 0.57 | 20 | 0.78 | 4.0 |
| Em-7 | 8.8 | 25 | 0.61 | 23 | 0.77 | 4.4 |
| Em-8 | 8.8 | 25 | 0.61 | 23 | 0.77 | 4.4 |
| Em-9 | 8.9 | 18 | 0.84 | 26 | 1.03 | 3.7 |
| Em-10 | 1.7 | 10 | 0.46 | 15 | 0.50 | 4.2 |
| Em-11 | 8.8 | 18 | 0.64 | 23 | 0.85 | 5.2 |
| Em-12 | 14.0 | 25 | 1.28 | 26 | 1.46 | 3.5 |
| Em-13 | 1.0 | — | 0.07 | 15 | — | 1 |

In Table 6, (1) Emulsions Em-10 to Em-12 were subjected to reduction sensitization by use of thiourea dioxide and thiosulfonic acid on preparing grains according to an example of JP-A-2-191938 (corresponding to U.S. Pat. No. 5,061,614).

(2) Emulsions Em-1 to Em-9 were subjected to gold sensitization, sulfur sensitization, and selenium sensitization in the presence of spectral sensitizing dyes specified in the respective sensitive layers and sodium thiocyanate according to an example of JP-A-3-237450 (corresponding to EP-A-443453).

(3) On preparing tabular grains, low-molecular gelatin was used according to an example of JP-A-1-158426.

(4) In the tabular grains, dislocation lines as described in JP-A-3-237450 (corresponding to EP-A-443453) were observed with the aid of a high-pressure electron microscope.

(5) Emulsion Em-12 contained double structure grains having internal high iodine cores described in JP-A-60-143331.

Preparation of Dispersion of Organic Solid Disperse Dye

The following ExF-2 was dispersed in a manner described below. That is, 21.7 ml of water, 3 ml of a 5% aqueous solution of sodium p-octylphenoxyethoxyethoxyethanesulfonate, and 0.5 g of a 5% aqueous solution of p-octylphenoxypolyoxyethylene ether (polymerization degree 10) were placed in a 700-ml pot mill, and 5.0 g of dye ExF-2 and 500 ml of zirconium oxide beads (diameter 1 mm) were added to the solution, and dispersed for 2 hours. A BO-type vibration ball mill manufactured by Chuo-koki Co., Ltd., was used for the dispersion. After being dispersed, the contents were taken out of the ball mill, and added to 8 g of a 12.5% aqueous solution of gelatin. The beads were then filtered out to prepare a dye-gelatin dispersion. The average particle size of the finely divided dye was 0.44 μm.

Similarly, solid dispersions of ExF-3, ExF-4 and ExF-6 were prepared. The average particle sizes of the finely divided dyes were 0.24, 0.45 and 0.52 μm, respectively. ExF-5 was dispersed by amicroprecipitation dispersion process described in Example 1 of EP-A-549489. The average particle size was 0.06 μm.

ExC-1

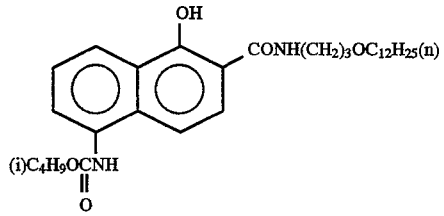

ExC-2

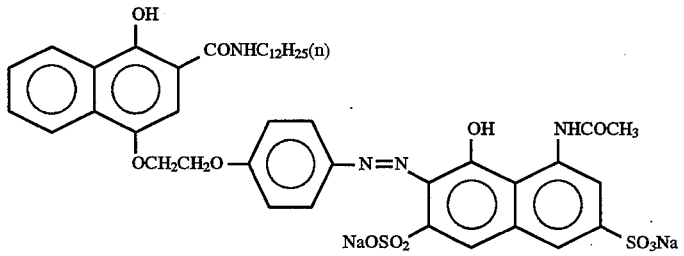

ExC-3

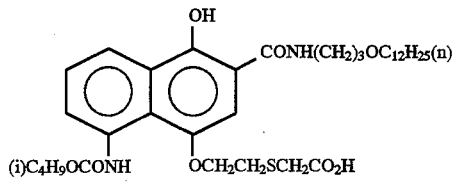

ExC-4

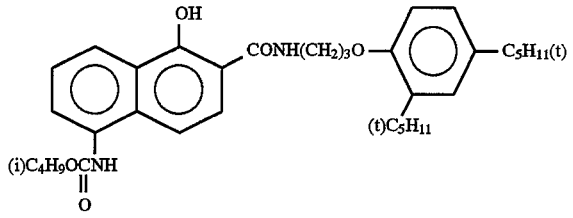

-continued
ExC-5
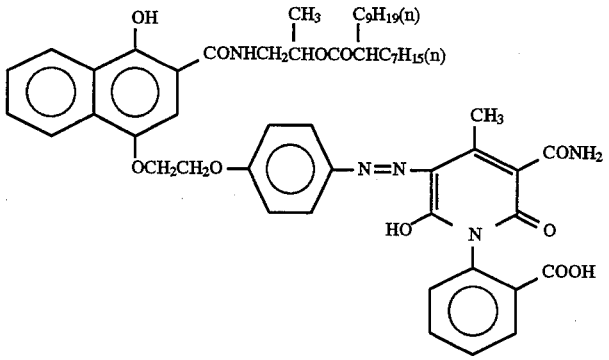
ExC-6
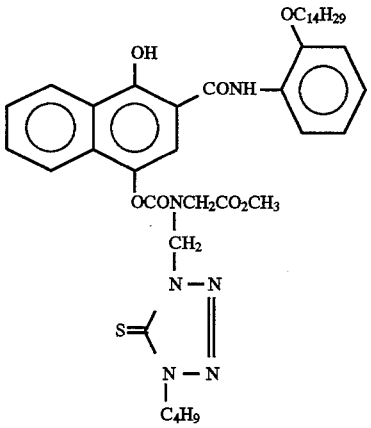
ExC-7
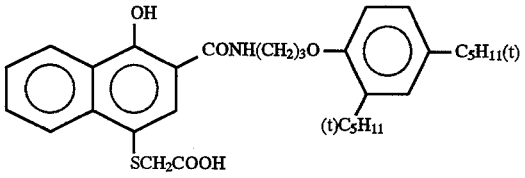
ExC-8
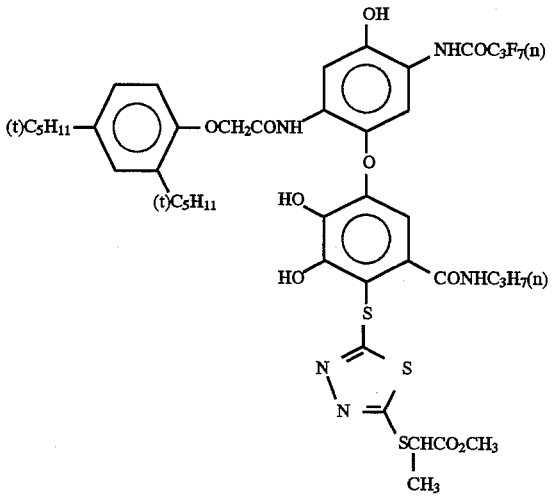

-continued
ExM-1
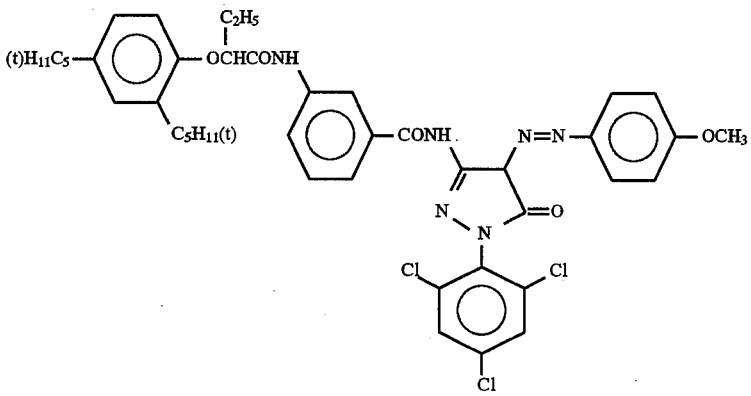
ExM-2
n = 50, m = 25, m' = 25,
Molecular Weight: about 20,000
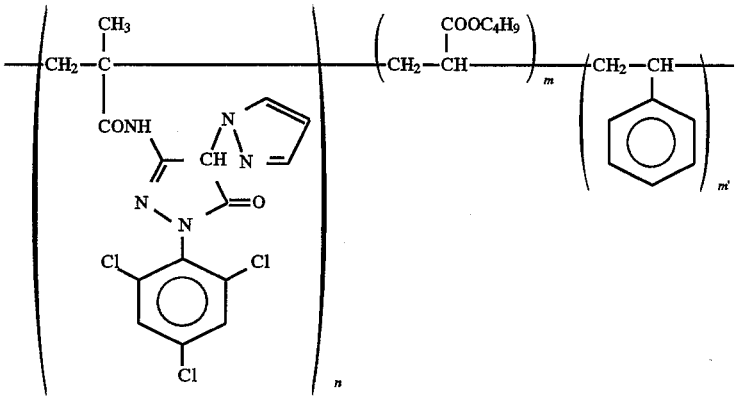
ExM-3
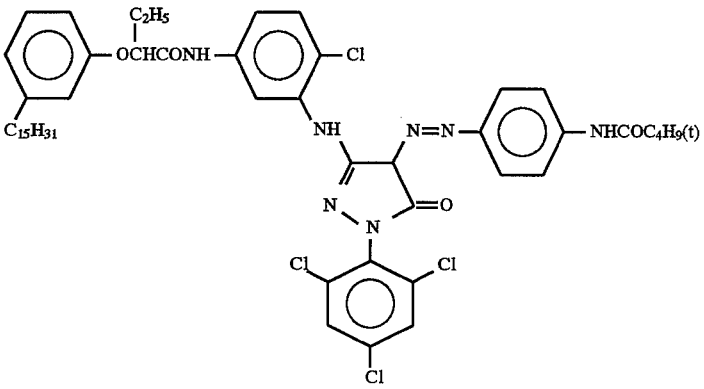
ExM-4
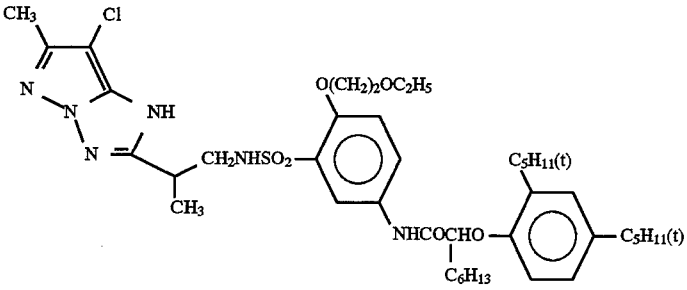

-continued
ExM-5
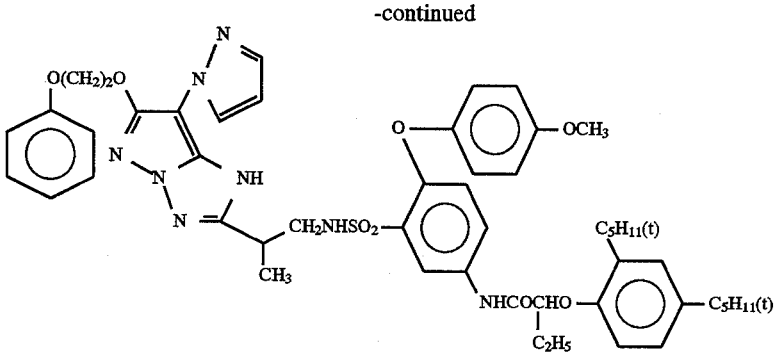
ExY-1
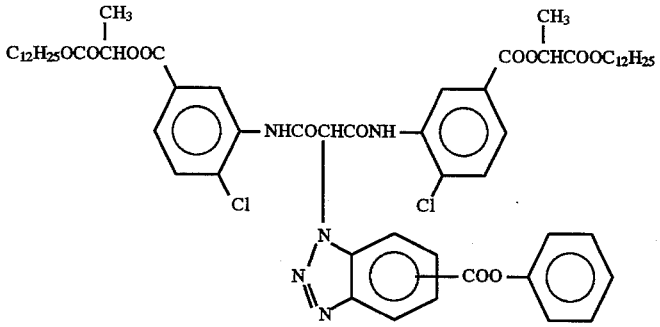
ExY-2
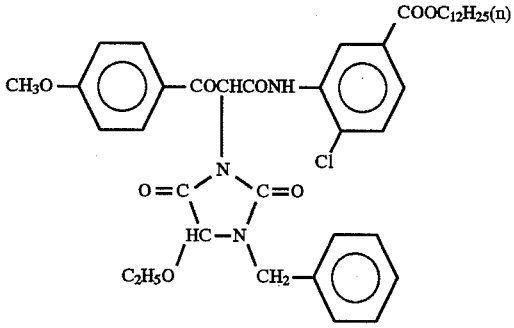
ExY-3
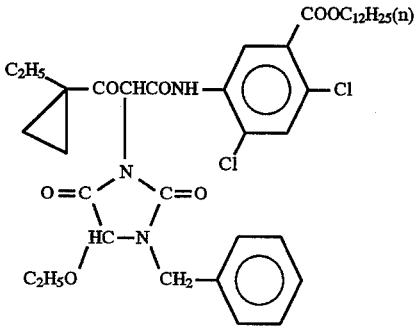
ExY-4
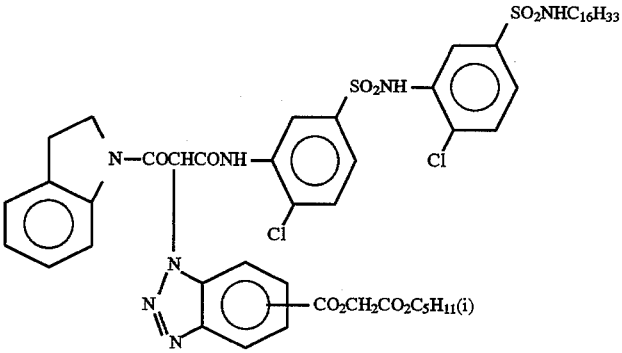

-continued
ExY-5
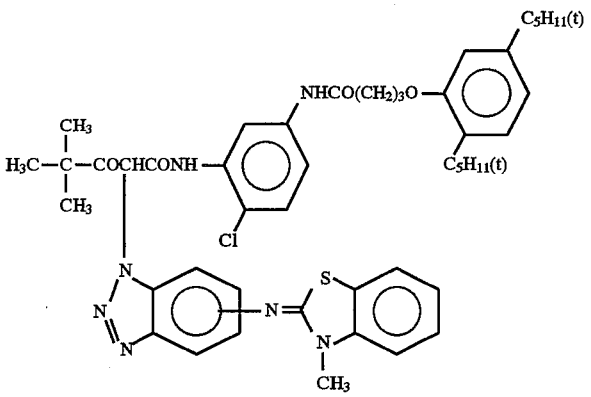
ExF-1
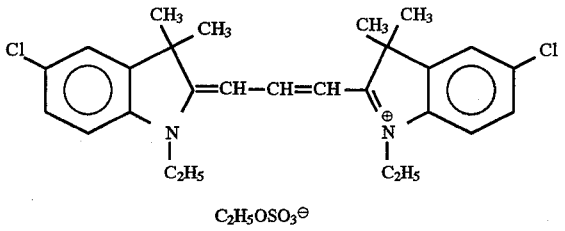
ExF-2
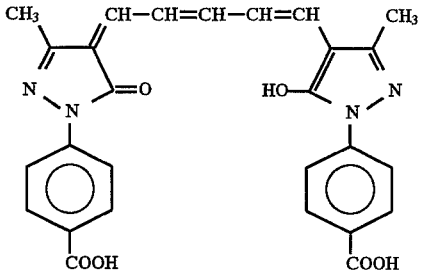
ExF-3
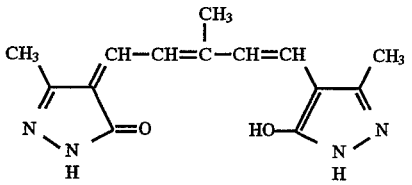
ExF-4
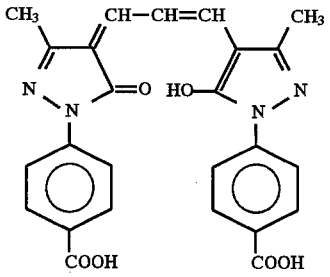
ExF-5
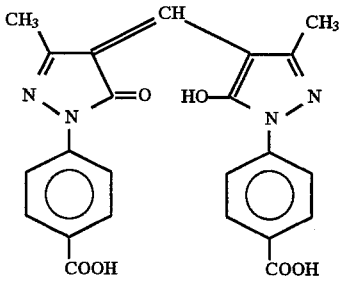

-continued
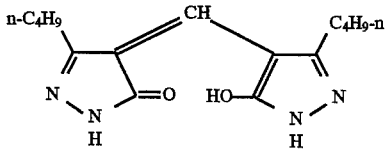
ExF-6
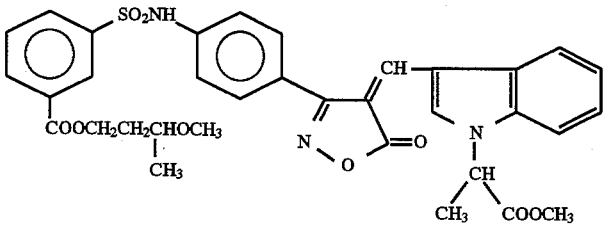
ExF-7
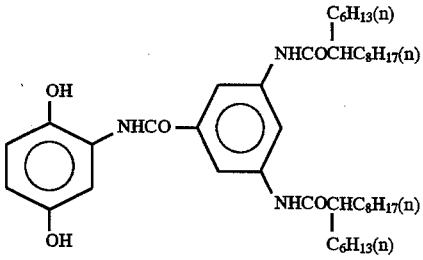
Comp-1
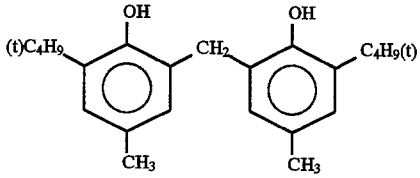
Comp-2
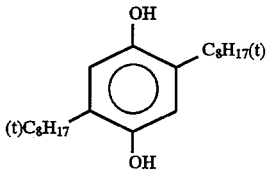
Comp-3
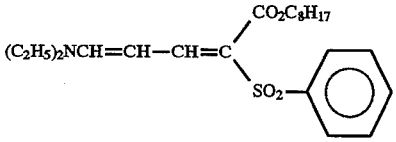
UV-1
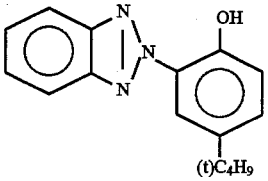
UV-2
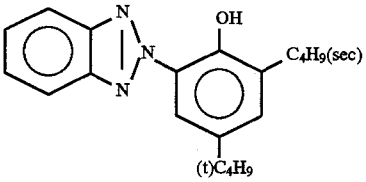
UV-3
Tricresyl phosphate HBS-1
Di-n-butyl phthalate HBS-2

-continued
HBS-3
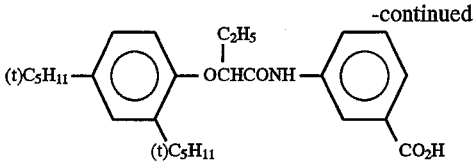
Tri(2-ethylhexyl) Phosphate
HBS-4
ExS-1
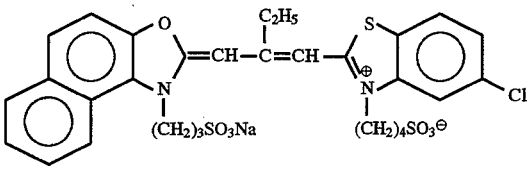
ExS-2
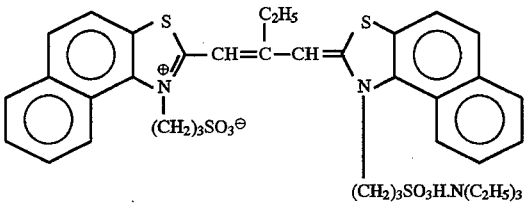
ExS-3
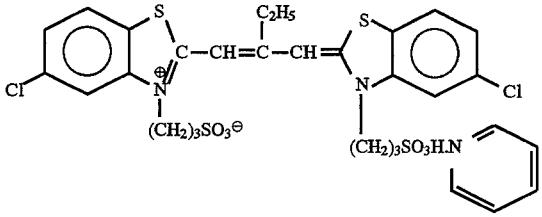
ExS-4
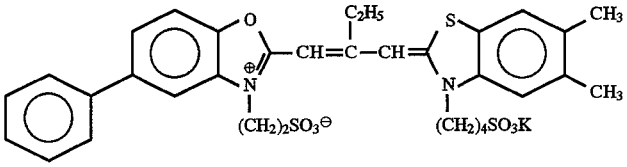
ExS-5
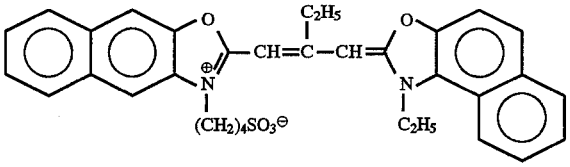
ExS-6
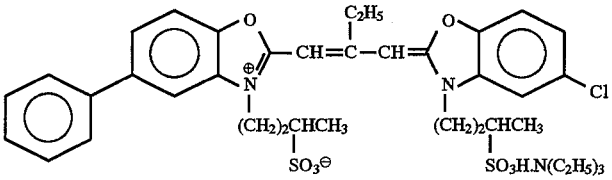
ExS-7
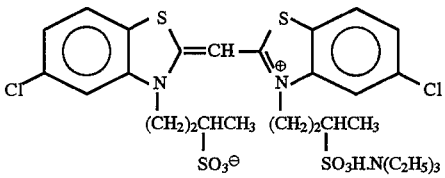
Comp-4
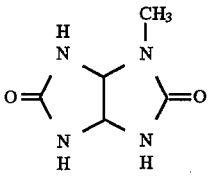

-continued
H-1
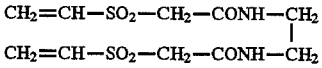
B-1
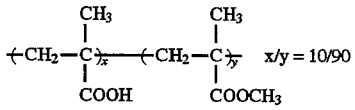
x/y = 10/90
B-2
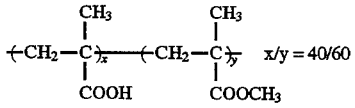
x/y = 40/60
B-3
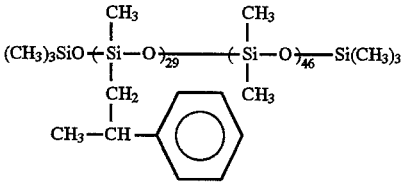
B-4
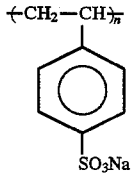
(n = an integer of ca. 1,000)
B-5
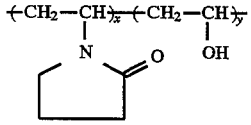
x/y = 70/30
B-6
Molecular Weight:about 10,000
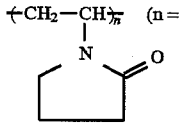
(n = an integer)
WS-1
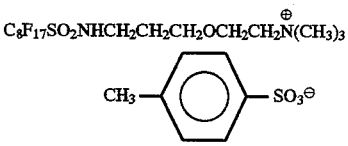
WS-2
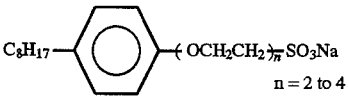
n = 2 to 4
WS-3
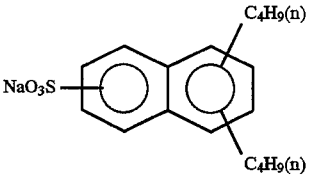
FS-1
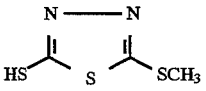

-continued
FS-2
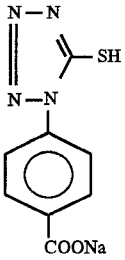
FS-3
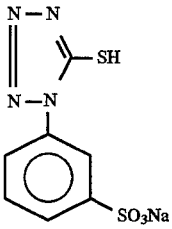
FS-4
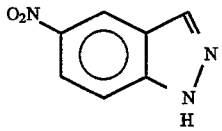
FS-5
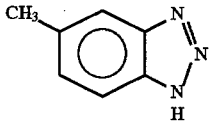
FS-6
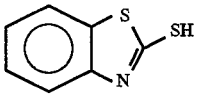
FS-7
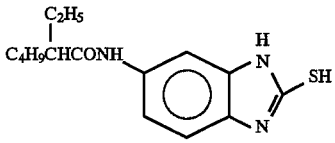
FS-8
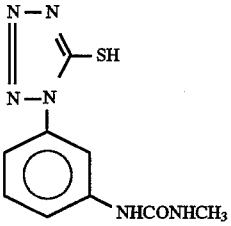
FS-9
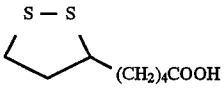
FS-10
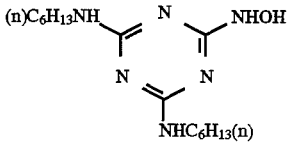
FS-11
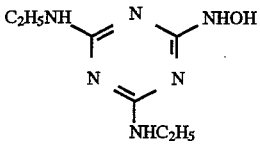

-continued

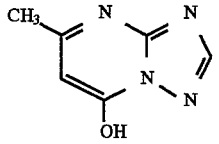

FS-12

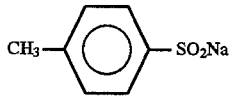

FS-13

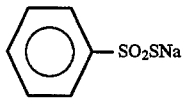

FS-14

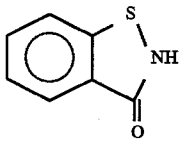

FS-15

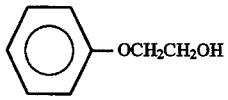

FS-16

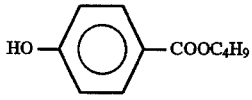

FS-17

Similarly, samples 302 to 307 were prepared, except that couplers shown in Table 7 were used in place of cyan couplers ExC-1 and ExC-4 used in the third, fourth, and fifth layers of sample 301. The pyrroloazole coupler contents of the respective layers were 50% of the total molar quantities of ExC-1 and ExC-4 used for those layers of sample 301.

TABLE 7

| Sample | The Fourth Layer | The Fifth Layer | The Sixth Layer |
|---|---|---|---|
| 302 | Comparative | Comparative | Comparative |
| CE*[1] | Coupler-1 | Coupler-1 | Coupler-1 |
| 303 | Comparative | Comparative | Comparative |
| CE | Coupler-2 | Coupler-2 | Coupler-2 |
| 304 | (3) | (27) | (23) |
| PI*[2] | | | |
| 305 | (5) | (14) | (1) |
| PI | | | |
| 306 | (26) | (36) | (40) |
| PI | | | |
| 307 | (3) | (27) | Comparative |
| PI | | | Coupler-2 |

*[1]CE: Comparative Example;
*[2]PI: Present Invention

Samples 301 to 307 were subjected to stepwise exposure by use of the white light, and then to processing as described in JP-A-2-90151. RMS values of cyan images were measured in a manner similar to Example 1 to compare the graininess. The samples of the present invention were found to exhibit excellent graininess.

While the invention has been described in detail and with reference to specific examples thereof, it will be apparent to one skilled in the art that various changes and modifications can be made therein without departing from the spirit and scope thereof.

What is claimed is:

1. A silver halide color photographic material comprising at least one layer provided on a support, said layer containing a coupler represented by the following formula

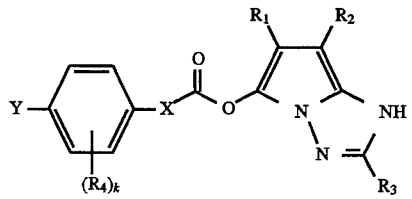

(7-1)

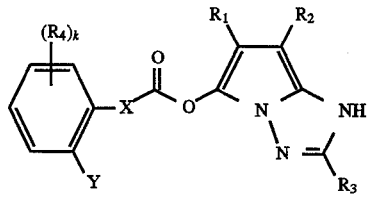

(7-2)

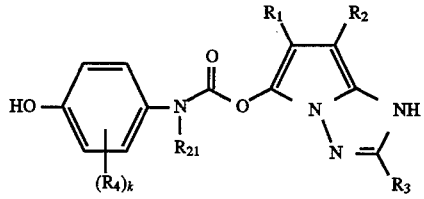

(8-1)

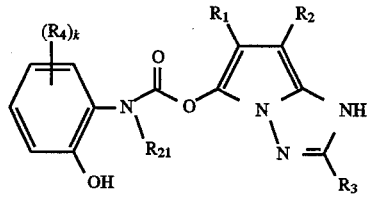

(8-2)

wherein $R_1$ and $R_2$ each represents an electron attractive group having a Hammett substituent constant $\sigma_p$ of 0.2 to 1.0; $R_3$ represents a substituent; X represents —O— or —N($R_{21}$)—; Y represents —OH, —N($R_{22}$)($R_{23}$), or —$NHSO_2R_{24}$ which is substituted at the ortho-position or para-position to X, with the proviso that, when X is —$N(R_{21})$—, Y can not be —$N(R_{22})(R_{23})$ attached to the para-position to X; $R_{21}$, $R_{22}$ and $R_{23}$ each represents a hydrogen atom, an aliphatic group, or an aryl group; $R_{24}$ represents an aliphatic group or an aryl group; $R_4$ represents a substituent, and has the same meanings as $R_3$; and k represents 0 or an integer of 1 to 4.

2. The silver halide color photographic material as claimed in claim 1, wherein $R_1$ and $R_2$ each represents an electron attractive group having a Hammett substituent constant $\sigma_p$ of 0.3 to 0.8.

3. The silver halide color photographic material as claimed in claim 1, wherein the sum of the Hammett substituent constants $\sigma_p$ of $R_1$ and $R_2$ is 0.7 to 1.8.

4. The silver halide color photographic material as claimed in claim 1, wherein the content of said coupler in the photographic material is from $1\times10^{-3}$ to 1 mole per mole of silver halide in layer.

5. The silver halide color photographic material as claimed in claim 1, wherein $R_1$ is a cyano group.

6. The silver halide color photographic material as claimed in claim 1, wherein $R_2$ is an aliphatic oxycarbonyl group.

7. The silver halide color photographic material as claimed in claim 6, wherein $R_2$ is an aliphatic oxycarbonyl group represented by the following formula (4):

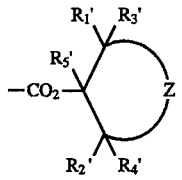

(4)

wherein $R_1'$ and $R_2'$ each represents an aliphatic group having 36 or less carbon atoms; $R_3'$, $R_4'$ and $R_5'$ each represents a hydrogen atom or an aliphatic group, examples of which include the groups described above as $R_1'$ and $R_2'$; and Z represents a group of nonmetallic atoms required to form a 5- to 8-membered ring.

8. The silver halide color photographic material as claimed in claim 1, wherein $R_3$ is an aryl or alkyl group.

9. The silver halide color photographic material as claimed in claim 1, wherein the sum of $\sigma_p$ values of $R_1$ and $R_2$ is from 0.3 to 0.8.

10. The silver halide color photographic material as claimed in claim 1, wherein substituents $R_1$ and $R_2$ are selected from the group consisting of acyl groups, acyloxy groups, carbamoyl groups, aliphatic oxycarbonyl groups, aryl oxycarbonyl groups, a cyano group, a nitro group, dialkylphosphono groups, diarylphosphono groups, diarylphosphinyl groups, alkylphosphinyl groups, arylsulfinyl groups, alkylsulfonyl groups, arylsulfonyl groups, sulfonyloxy groups, acylthio groups, sulfamoyl groups, a thiocyanate group, a thiocarbonyl group, alkyl groups substituted by at least 2 or more halogen atoms, alkoxy groups substituted by at least 2 or more halogen atoms, aryloxy groups substituted by at least 2 or more halogen atoms, alkylamino groups substituted by at least 2 or more halogen atoms, alkylthio groups substituted by at least 2 or more halogen atoms, aryl groups substituted by additional electron attractive groups having $\sigma_p$ values of 0.20 or more, heterocyclic groups, a chlorine atom, a bromine atom, an azo group, and a selenocyanate group.

11. The silver halide color photographic material as claimed in claim 1, wherein $R_1$ and $R_2$ are selected from the group consisting of a bromine atom, a chlorine atom, a cyano group, a nitro group, a trifluoromethyl group, a tribromomethyl group, a trichloromethyl group, a carboxyl group, an acetyl group, a benzoyl group, an acetyloxy group, a trifluoromethanesulfonyl group, a methanesulfonyl group, a benzenesulfonyl group, a methanesulfinyl group, a carbamoyl group, a methoxycarbonyl group, an ethoxycarbonyl group, a phenoxycarbonyl group, a pyrazolyl group, a methanesulfonyloxyl group, a dimethoxyphosphoryl group, and a sulfamoyl group.

12. The silver halide color photographic material as claimed in claim 1, wherein $R_1$ is selected from the group consisting of a cyano group, aliphatic oxycarbonyl groups having 36 or less carbon atoms, dialkylphosphono groups having 36 or less carbon atoms, alkylsulfonyl or arylsulfonyl groups having 36 or less carbon atoms, and fluorinated alkyl groups having 36 or less carbon atoms.

13. The silver halide color photographic material as claimed in claim 1, wherein $R_2$ is selected from the group consisting of aliphatic oxycarbonyl groups having 36 or less carbon atoms, carbamoyl groups having 36 or less carbon atoms, sulfamoyl groups having 36 or less carbon atoms, dialkylphosphono groups having 36 or less carbon atoms, and diarylphosphono groups having 48 or less carbon atoms.

14. The silver halide color photographic material as claimed in claim 1, wherein $R_3$ and $R_4$ are substituted or unsubstituted and are selected from the group consisting of halogen atoms, aliphatic groups, aryl groups, heterocyclic groups, a cyano group, a hydroxyl group, a nitro group, a carboxyl group, a sulfo group, aliphatic oxy groups, aryloxy groups, heterocyclic oxy groups, acylamino groups, amino groups, anilino groups, heterocyclic amino groups, ureido groups, sulfamoylamino groups, aliphatic thio groups, arylthio groups, heterocyclic thio groups, aliphatic oxycarbonylamino groups, aryloxycarbonyiamino groups, sulfonamido groups, carbamoyl groups, sulfamoyl groups, sulfonyl groups, aliphatic oxycarbonyl groups, aryloxycarbonyl groups, azo groups, acyloxy groups, carbamoyloxy groups, sulfamoyloxy groups, silyloxy groups, imido groups, sulfinyl groups, phosphonyl groups, and acyl groups.

* * * * *